US010416694B2

(12) United States Patent
Ono et al.

(10) Patent No.: US 10,416,694 B2
(45) Date of Patent: Sep. 17, 2019

(54) REGULATOR CIRCUIT

(71) Applicant: Panasonic Intellectual Property Management Co., Ltd., Osaka (JP)

(72) Inventors: Takashi Ono, Osaka (JP); Reiji Mochida, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/131,472

(22) Filed: Sep. 14, 2018

(65) Prior Publication Data

US 2019/0011944 A1 Jan. 10, 2019

Related U.S. Application Data

(63) Continuation of application No. PCT/JP2017/011308, filed on Mar. 22, 2017.

(30) Foreign Application Priority Data

Mar. 25, 2016 (JP) ..... 2016-061681

(51) Int. Cl.
*G05F 1/565* (2006.01)
*G05F 1/56* (2006.01)
(Continued)

(52) U.S. Cl.
CPC ..... *G05F 1/565* (2013.01); *G05F 1/56* (2013.01); *G05F 1/575* (2013.01); *G05F 1/59* (2013.01)

(58) Field of Classification Search
CPC . G05F 1/565; G05F 1/575; G05F 1/59; G05F 1/56
See application file for complete search history.

(56) References Cited

U.S. PATENT DOCUMENTS 7,161,339 B2 * 1/2007 Chen ..... G05F 1/575 323/274
7,173,401 B1 * 2/2007 Huang ..... G05F 1/575 323/273

(Continued)

FOREIGN PATENT DOCUMENTS

EP 1 865 397 A1 12/2007
JP 2007-334573 A 12/2007
JP 2009-044714 A 2/2009

OTHER PUBLICATIONS

International Search Report and Written Opinion issued in International Application No. PCT/JP2017/011308 dated Jun. 20, 2017.

*Primary Examiner* — Kyle J Moody
(74) *Attorney, Agent, or Firm* — McDermott Will & Emery LLP

(57) ABSTRACT

A regulator circuit includes: a voltage detection circuit that detects a magnitude of an output voltage of an output node, and outputs a feedback voltage that indicates a result of the detection; an error amplifier circuit that compares the feedback voltage with a reference voltage, and outputs a voltage that indicates a result of the comparison; an output circuit that supplies an output current to the output node according to the voltage output by the error amplifier circuit; a current detection circuit that detects a magnitude of the output current; and a current bias circuit that supplies an output bias current to the output node, and increases or decreases the output bias current based on a result of the detection of the current detection circuit.

14 Claims, 12 Drawing Sheets

(51) Int. Cl.
*G05F 1/575* (2006.01)
*G05F 1/59* (2006.01)

(56) References Cited

U.S. PATENT DOCUMENTS

| | | | | |
|---|---|---|---|---|
| 7,332,957 | B2 * | 2/2008 | Hasegawa | G05F 1/575 323/315 |
| 8,174,251 | B2 * | 5/2012 | Kimura | G05F 1/575 323/273 |
| 8,232,783 | B2 * | 7/2012 | Yanagawa | G05F 1/575 323/277 |
| 8,378,654 | B2 | 2/2013 | Chern et al. | |
| 8,680,828 | B2 * | 3/2014 | Heng | G05F 1/575 323/275 |
| 8,716,993 | B2 * | 5/2014 | Kadanka | G05F 1/56 323/274 |
| 10,001,793 | B2 * | 6/2018 | Chu | G05F 3/30 |
| 2008/0007231 | A1 | 1/2008 | Maige et al. | |
| 2008/0252501 | A1 | 10/2008 | Mechnig | |
| 2010/0156367 | A1 | 6/2010 | Takagi | |
| 2018/0136681 | A1 * | 5/2018 | Chang | G05F 1/618 |

* cited by examiner

REGULATOR CIRCUIT

CROSS REFERENCE TO RELATED APPLICATIONS

This application is a U.S. continuation application of PCT International Patent Application Number PCT/JP2017/011308 filed on Mar. 22, 2017, claiming the benefit of priority of Japanese Patent Application Number 2016-061681 filed on Mar. 25, 2016, the entire contents of which are hereby incorporated by reference.

BACKGROUND

1. Technical Field

The present disclosure relates to a regulator circuit.

2. Description of the Related Art

A conventional regulator circuit will be described. FIG. 12A is a diagram showing a configuration of a conventional regulator circuit disclosed in U.S. Pat. No. 8,378,654. PMOS transistor 202 in an output stage of the regulator circuit supplies a sufficient electric current to a load. Bias voltage $V_{BIAS}$ causes NMOS transistor 204 to operate in a saturation region, independent of the environment.

FIG. 12B is a diagram showing the properties of the output voltage with respect to the load current of the regulator circuit shown in FIG. 12A. Because NMOS transistor 204 operates in a saturation region, the output voltage variation relative to the change in the load current is relatively small.

As described above, in the conventional regulator circuit disclosed in U.S. Pat. No. 8,378,654, by connecting NMOS transistor 204 that operates in a saturation region to output VREG, and allowing a constant output bias current to flow through NMOS transistor 204 so as to increase the minimum value of the output current, the output voltage variation relative to the change in the load current is suppressed.

However, in the conventional regulator circuit disclosed in U.S. Pat. No. 8,378,654, there is a problem in that because the constant output bias current flows independent of the load current, when the load current is large, the output voltage drops significantly as compared with when the output bias current is not allowed to flow.

The present disclosure has been made in view of the problem described above, and provides a regulator circuit, wherein it is possible to suppress the output voltage variation relative to the change in the load current, and also suppress the drop in the output voltage even when the load current is large.

SUMMARY

In order to solve the problem described above, a regulator circuit according to one aspect of the present disclosure includes: a voltage detection circuit that detects a magnitude of an output voltage of an output node, and outputs a feedback voltage that indicates a result of the detection; an error amplifier circuit that compares the feedback voltage with a reference voltage, and outputs a voltage that indicates a result of the comparison; an output circuit that supplies an output current to the output node according to the voltage output by the error amplifier circuit; a current detection circuit that detects a magnitude of the output current; and a current bias circuit that supplies an output bias current to the output node, and increases or decreases the output bias current based on a result of the detection of the current detection circuit.

In the regulator circuit according to one aspect of the present disclosure, it is possible to suppress the output voltage variation relative to the change in the load current, and also suppress the drop in the output voltage even when the load current is large.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE EMBODIMENTS

Underlying Knowledge Forming Basis of the Present Disclosure

The inventors of the present disclosure found that there is the following problem in the regulator circuit disclosed in the Background Art.

Figure 12A:
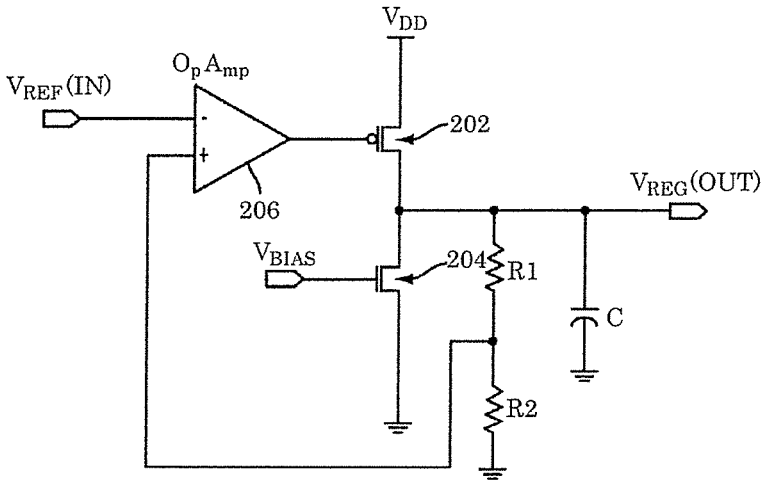
FIG. 12A PRIOR ART
FIG. 12A is a diagram showing a conventional regulator circuit that is disclosed in U.S. Pat. No. 8,378,654.
Figure 12B:
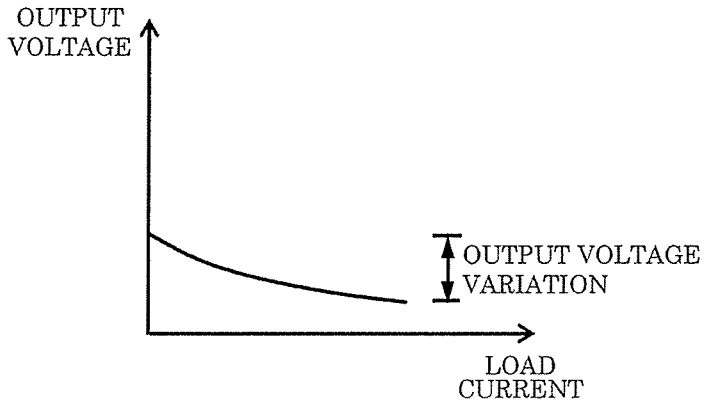
FIG. 12B PRIOR ART
FIG. 12B is a diagram showing the properties of the conventional regulator that is disclosed in U.S. Pat. No. 8,378,654.
Figure 13:
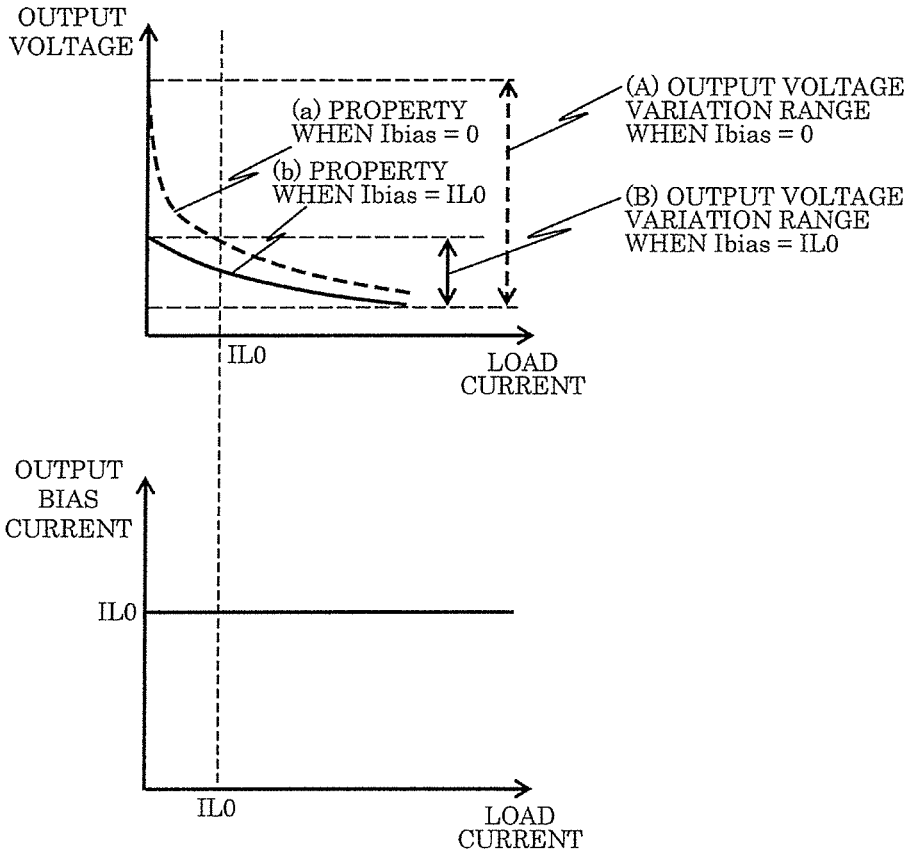
FIG. 13 is a diagram showing the properties of the conventional regulator circuit.

FIG. 13 is a diagram showing the property examples of the conventional regulator circuit shown in FIG. 12A. The upper part of the diagram shows a relationship between load current and output voltage of the conventional regulator circuit. The lower part of the diagram shows a relationship between load current and output bias current.

In the upper part of FIG. 13, the solid line indicates properties when NMOS transistor 204 allows constant output bias current Ibias to flow from output VREG (i.e., Ibias=IL0). On the other hand, the dotted line indicates the properties when NMOS transistor 204 does not allow output bias current Ibias to flow from output VREG Ibias=0).

Output current Iout that flows through PMOS transistor 202 can be represented by Equation (1) given below, where Irdiv represents the electric current that flows through resistor R1 and resistor R2, and Iload represents the load current that flows through a load connected to output VREG.

$$Iout = Ir\ div + Ibias + Iload \quad (1)$$

PMOS transistor 202 is sized to be capable of supplying electric current even when output current Iout represented by Equation (1) is maximum.

The regulator circuit shown in FIG. 12A performs operation so as to control output current Iout of PMOS transistor 202 by using the output voltage of the operational amplifier, and suppress the variation of the output voltage. In general, the current supply capability of PMOS transistor 202 is proportional to a square of a difference between the voltage of power supply node VDD and the output voltage of the operational amplifier. For this reason, as shown in FIG. 13, the variation of the output voltage of PMOS transistor 202 is larger as a difference (the amount of change) between the maximum value and the minimum value of the output current of PMOS transistor 202 is larger, and the minimum value at this time is smaller.

As is clear from Equation (1) given above, allowing output bias current Ibias to flow as a portion of current Iout in addition to load current Iload is substantially equivalent to increasing load current Iload when output bias current Ibias is not allowed to flow (Ibias=0). For this reason, properties (b) when output bias current Ibias is allowed to flow are the same as properties (a) when output bias current Ibias is not allowed to flow that have been shifted in parallel in the left direction along the axis of load current Iload by an amount corresponding to output bias current Ibias that is allowed to flow (=IL0). Also, output voltage variation range (B) when output bias current Ibias is allowed to flow is smaller than output voltage variation range (A) when output bias current Ibias is not allowed to flow.

In the conventional regulator circuit, as can be seen from FIG. 13, there is a problem in that because constant output bias current Ibias is allowed to flow independent of load current Iload, when load current Iload is large, the drop in output voltage increases as compared with when output bias current Ibias does not flow.

In order to solve the problem described above, a regulator circuit according to one aspect of the present disclosure includes: a voltage detection circuit that detects a magnitude of an output voltage of an output node, and outputs a feedback voltage that indicates a result of the detection; an error amplifier circuit that compares the feedback voltage with a reference voltage, and outputs a voltage that indicates a result of the comparison; an output circuit that supplies an output current to the output node according to the voltage output by the error amplifier circuit; a current detection circuit that detects a magnitude of the output current; and a current bias circuit that supplies an output bias current to the output node, and increases or decreases the output bias current based on a result of the detection of the current detection circuit.

With this configuration, it is possible to suppress the output voltage variation relative to the change in the load current, and also suppress the drop in the output voltage even when the load current is large.

For example, in the regulator circuit, the magnitude of the output current that flows through the output circuit is detected by the current detection circuit, and control is performed so as to decrease the output bias current according to the increase in the detection current based on the result of the detection, and increase the output bias current according to the decrease in the detection current. With this configuration, the variation of the output current that flows through the output circuit can be suppressed. As a result, the output voltage variation relative to the load current variation can be reduced, and when the load current is large, control is performed so as to not allow the output bias current to flow, and it is therefore possible to suppress the drop in the output voltage.

Hereinafter, embodiments according to the present disclosure will be described with reference to the drawings.

Embodiment 1

Figure 1:
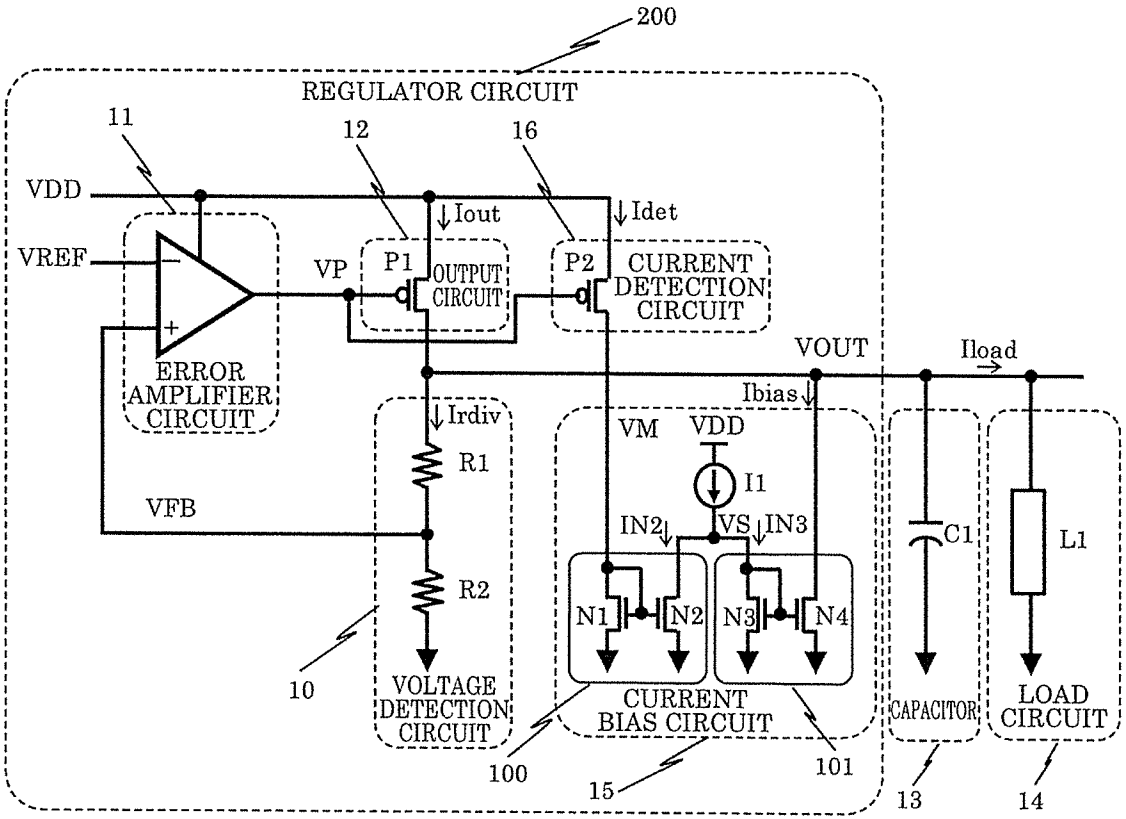
FIG. 1 is a diagram showing a configuration example of a regular circuit according to Embodiment 1, and peripheral circuits of the regular circuit.

FIG. 1 is a diagram showing a configuration example of regulator circuit 200 according to Embodiment 1, and peripheral circuits of the regular circuit.

Regulator circuit 200 shown in the diagram includes voltage detection circuit 10, error amplifier circuit 11, output circuit 12, current bias circuit 15, and current detection circuit 16. Also, in the diagram, capacitor 13 and load circuit 14 are shown as peripheral circuits. Capacitor 13 is composed of capacitor C1, and is provided in order to suppress AC variation of output node VOUT. Load circuit 14 is composed of load circuit L1, and load current Iload flows in a direction in which it flows from output node VOUT.

Regulator circuit 200 includes: voltage detection circuit 10 that outputs feedback voltage VFB according to output voltage VOUT of output node VOUT; error amplifier circuit 11 that outputs voltage VP that is a result of comparison between feedback voltage VFB of voltage detection circuit 10 and reference voltage VREF; output circuit 12 that supplies output current Iout to output node VOUT according to output voltage VP of error amplifier circuit 11; current detection circuit 16 that monitors output current Iout of output circuit 12, and outputs detection current Idet according to output current Iout; and current bias circuit 15 that increases or decreases output bias current Ibias according to detection current Idet of current detection circuit 16.

Voltage detection circuit 10 is composed of resistors R1 and R2 that are connected in series between output node VOUT and a ground node. Voltage detection circuit 10 detects the magnitude of output voltage VOUT of the output node, and outputs feedback voltage VFB that indicates a result of the detection. Feedback voltage VFB is taken from a connection point of resistors R1 and R2.

Error amplifier circuit 11 receives an input of reference voltage VREF at its inverting input terminal, receives an input of feedback voltage VFB at its non-inverting input terminal, compares reference voltage VREF and feedback voltage VFB, and outputs voltage VP that is a result of the comparison. Error amplifier circuit 11 is driven by the voltage of power supply node VDD.

Output circuit 12 is composed of PMOS transistor P1, and supplies an output current to the output node according to the output voltage of error amplifier circuit 11. PMOS transistor P1 includes a gate that is connected to output VP of error amplifier circuit 11, a source that is connected to power supply node VDD, and a drain that is connected to output node VOUT. PMOS transistor P1 supplies output current Iout to output node VOUT according to voltage VP that is an output of error amplifier circuit 11. That is, in output circuit 12, when feedback voltage VFB that is an output of voltage detection circuit 10 is higher than reference voltage VREF, output voltage VP of error amplifier circuit 11 becomes high. When output voltage VP becomes high, the gate voltage of PMOS transistor P1 in output circuit 12 becomes high. Accordingly, in output circuit 12, the driving capability of PMOS transistor P1 decreases, and operation is performed such that output voltage VOUT decreases. On the other hand, when feedback voltage VFB is lower than reference voltage VREF, output circuit 12 performs operation opposite to the above operation such that output voltage VOUT increases. Accordingly, output circuit 12 performs operation such that output voltage VOUT becomes constant, or to be more accurate, such that variation of output voltage VOUT is suppressed.

Current detection circuit 16 is composed of PMOS transistor P2, and detects the magnitude of the output current of output circuit 12. PMOS transistor P2 includes a gate that is connected to output VP of error amplifier circuit 11, a source that is connected to power supply node VDD, and a drain that is connected to node VM. With this configuration, current detection circuit 16 outputs detection current Idet according to output current Iout of output circuit 12. Here, when PMOS transistors P1 and P2 operate in a saturation region, the relationship between detection current Idet and output current Iout can be represented by Equation (2) given below, where the size ratio of PMOS transistor P1 of output circuit 12 to PMOS transistor P2 of current detection circuit 16 is k:1.

$$I\text{det}=(1/k)\times I\text{out} \tag{2}$$

That is, detection current Idet is proportional to output current Iout, and is (1/k) times output current Iout.

Current bias circuit 15 allows variable output bias current Ibias to flow from output node VOUT, and increases or decreases output bias current Ibias based on the result of the detection of current detection circuit 16. For example, current bias circuit 15 decreases output bias current Ibias when the result of the detection of current detection circuit 16 indicates an increase in output current Iout, and increases output bias current Ibias when the result of the detection of current detection circuit 16 indicates a decrease in output current Iout.

To be specific, current bias circuit 15 is composed of first current source I1, first current mirror 100, and second current mirror 101. First current source I1 includes a first terminal that is connected to power supply node VDD, and a second terminal that is connected to node VS. First current mirror 100 includes an input terminal that is connected to node VM, and an output terminal that is connected to node VS. Second current mirror 101 includes an input terminal that is connected to node VS, and an output terminal that is connected to output node VOUT.

Accordingly, current bias circuit 15 receives an input of detection current Idet of current detection circuit 16 via node VM, and outputs output bias current Ibias to output node VOUT as a sink current.

In this example, the first terminal of first current source I1 is connected to power supply node VDD. However, power supply node VDD is not necessarily identical to power supply node VDD that is used in error amplifier circuit 11, output circuit 12, and current detection circuit 16, and the first terminal of first current source I1 may be connected to a power supply node of different voltage. In the case where the voltage of power supply node VDD that is used in error amplifier circuit 11, output circuit 12, and current detection circuit 16 is relatively high, by using a voltage lower than that of power supply node VDD as the power supply node that is connected to the first terminal of first current source I1, the power consumption of regulator circuit 200 can be reduced.

First current mirror 100 is composed of NMOS transistors N1 and N2. NMOS transistor N1 includes a gate and a drain that are commonly connected to node VM (input), and a source that is connected to a ground node. On the other hand, NMOS transistor N2 includes a gate that is connected to node VM that is common to the gate of NMOS transistor N1, a drain that is connected node VS (output), and a source that is connected a ground node. Here, when NMOS transistor N2 operates in a saturation region, the relationship between current IN2 that flows through NMOS transistor N2 and detection current Idet can be represented by Equation (3) given below, where the size ratio of NMOS transistor N1 to NMOS transistor N2 is 1:m.

$$IN2=m\times I\text{det} \tag{3}$$

As described above, first current mirror 100 receives an input of detection current Idet, and outputs first current IN2 that is proportional to detection current Idet.

Second current mirror 101 is composed of NMOS transistors N3 and N4. NMOS transistor N3 includes a gate and a drain that are commonly connected to node VS (input), and a source that is connected to a ground node. On the other hand, NMOS transistor N4 includes a gate that is connected to node VS that is common to the gate of NMOS transistor N3, a drain that is connected to output node VOUT (output), and a source that is connected to a ground node. Here, when NMOS transistor N4 operates in a saturation region, the relationship between current IN3 that flows through NMOS transistor N3 and output bias current Ibias can be represented by Equation (4) given below, where the size ratio of NMOS transistor N3 to NMOS transistor N4 is 1:n.

$$I\text{bias}=n\times IN3 \tag{4}$$

As described above, second current mirror 101 receives an input of second current IN3, and outputs output bias current Ibias. As shown in Equation (4) given above, second current IN3 and output bias current Ibias are proportionally related.

Also, the relationship of current at node VS can be represented by Equation (5) given below, where the electric current that flows through first current source I1 is represented by I1.

$$I1=IN2+IN3 \tag{5}$$

The following Equation (6) is obtained from Equations (3) to (5) given above.

$$I1=m\times I\text{det}+(1/n)\times I\text{bias} \tag{6}$$

In Equation (6) given above, the left-hand side is current I1 of first current source I1, and the right-hand side is a sum of first current IN2 that is proportional to detection current Idet and second current IN3 that is proportional to output bias current Ibias. That is, current bias circuit 15 performs operation such that, current I1 of first current source I1, when it is set to an arbitrary constant value, is equal to a sum of current I1 of first current source I1 is equal to the sum of first current IN2 that is proportional to detection current Idet and second current IN3 that is proportional to output bias current Ibias. As a result, when detection current Idet increases, output bias current Ibias decreases, and when detection current Idet decreases, output bias current Ibias increases.

In this example, current I1 of first current source I1 is set to an arbitrary constant value. However, current I1 of first current source I1 may be set to a different arbitrary constant value according to the operation mode (switching of power supply voltage, load current, output voltage, and the like) of regulator circuit 200. By doing so, it is possible to reduce unnecessary current consumption according to the specifications and application of regulator circuit 200.

Because regulator circuit 200 is configured as described above, regulator circuit 200 satisfies Equations (1) to (6) given above within a range in which PMOS transistors P1 and P2, and NMOS transistors N1, N2, N3, and N4 operate in a saturation region.

From Equations (1) to (6) given above, output bias current Ibias can be represented by the following Equation (7). Accordingly, the dependency of output bias current Ibias on load current Iload can be adjusted by the transistor size ratio (k, m, n), current I1 of first current source I1, and current Irdiv that flows through voltage detection circuit 10.

$$I\text{bias}=(n\times(I1-(m/k)\times(I\text{load}+Ir\ \text{div})))/(1+(m\times n)/k) \quad (7)$$

Figure 2:
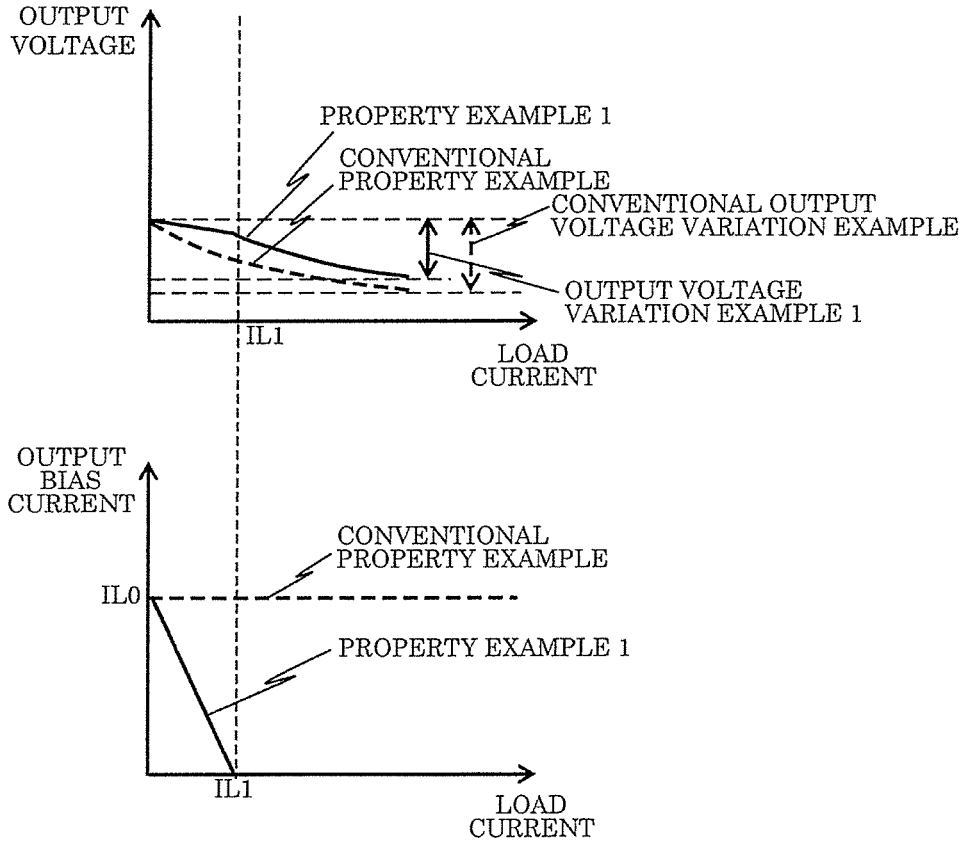
FIG. 2 is a diagram showing a property example of the regulator circuit according to Embodiment 1.

Next, the operations of regulator circuit 200 will be described with reference to FIGS. 2 and 3. FIG. 2 is a diagram showing a property example of regulator circuit 200 according to Embodiment 1, and FIG. 3 is a diagram showing another example of the same.

Figure 3:
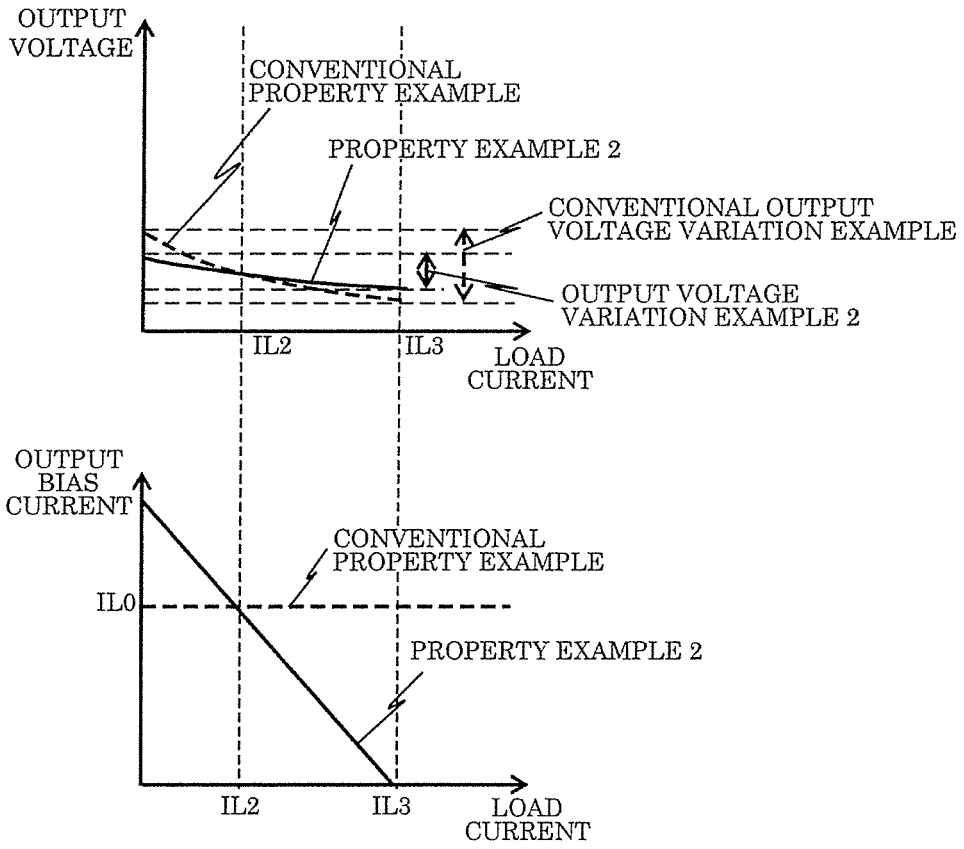
FIG. 3 is a diagram showing another property example of the regulator circuit according to Embodiment 1.

In FIGS. 2 and 3, Property Examples 1 and 2 indicated by solid lines show the properties of output voltage and output bias current when output bias current Ibias is allowed to flow from output node VOUT by current bias circuit 15 of regulator circuit 200 according to Embodiment 1. On the other hand, the dotted lines show the properties of output voltage and output bias current when constant output bias current Ibias is allowed to flow from output VREG by NMOS transistor 204 of the above-described conventional regulator circuit.

Property Examples 1 and 2 indicated by solid lines in FIGS. 2 and 3 are property examples in which the transistor size ratio (k, m, n), current I1 of first current source I1, and current Irdiv that flows through voltage detection circuit 10 that are design parameters in Equation (7) given above are set differently. In both FIGS. 2 and 3, for the purpose of comparison, the dotted lines show the properties of the conventional regulator circuit.

FIG. 2 shows properties when output bias current Ibias in an unloaded state (Iload=0) is set to match output bias current Ibias of NMOS transistor 204 of the conventional regulator circuit. Accordingly, output voltage VOUT in the unloaded state (Iload=0) is the same level as in conventional regulator circuit. Because current Iout that flows through PMOS transistor P1 of output circuit 12 increases when load current Iload increases, as indicated by Equation (2) given above, detection current Idet that flows through PMOS transistor P2 of current detection circuit 16 also increases accordingly.

Detection current Idet is input to current bias circuit 15, and in first current mirror 100, current IN2 that flows through NMOS transistor N2 is generated as indicated by Equation (3) given above in a voltage range of node VS where NMOS transistor N2 operates in a saturation region. Of current I1 that flows into node VS from first current source I1, current IN2 flows out from node VS by NMOS transistor N2, and the rest is input to second current mirror 101 so as to satisfy Equation (5) given above, and then flows out from node VS as current IN3 that flows through NMOS transistor N3. In second current mirror 101, current IN3 generates output bias current Ibias represented by Equation (4) given above, which is output to output node VOUT as a sink current.

Accordingly, when load current Iload increases, and current IN2 increases via detection current Idet, as indicated by Equation (5) given above, the proportion of the amount of current IN2 that flows out from node VS to the amount of current I1 of first current source I1 that flows into node VS increases, and the amount of current IN3 that flows out decreases. Thus, output bias current Ibias also decreases as indicated by Equation (4) given above. The voltage of node VS decreases due to an increase of current IN2, and when the voltage of node VS is less than or equal to a threshold voltage of NMOS transistors N3 and N4, NMOS transistors N3 and N4 operate in a sub-threshold region, and current IN3 and output bias current Ibias decrease. When NMOS transistor N2 operates in a linear region due to a decrease of the voltage of node VS, the voltage of node VS approaches the ground voltage, and current IN3 and output bias current Ibias reach substantially zero. It is therefore possible to avoid the drop in output voltage VOUT.

When NMOS transistor N2 enters a linear region as a result of the decrease of the voltage of node VS due to the increase of current IN2, current IN2 no longer satisfies Equation (3) given above, and is equal to the electric current that flows between node VS and the ground node via the on-resistance of NMOS transistor N2 biased by the gate-to-source voltage of the voltage of node VM and the drain-to-source voltage of the voltage of node VS. As described above, due to the decrease of the voltage of node VS, NMOS transistor N3 operates in a sub-threshold region, and the electric current that flows through NMOS transistor N3 decreases. For this reason, when NMOS transistor N2 operates in a linear region, current IN2 becomes substantially equal to current I1 of first current source I1.

In FIG. 2, output bias current Ibias is zero in load current Iload that is larger than load current Iload (=IL1) at which output bias current Ibias is substantially zero, and the relationship between output voltage VOUT and load current Iload becomes equal to the properties when output bias current Ibias of the conventional regulator circuit is zero.

With the operation described above, because output bias current Ibias decreases when load current Iload shown on the right-hand side of Equation (1) given above increases, the change in output current Iout on the left-hand side of Equation (1) given above is suppressed. Accordingly, the variation of output voltage VOUT can be reduced.

On the other hand, when load current Iload decreases from heavy load, output current Iout that flows through PMOS transistor P1 of output circuit 12 decreases, and detection current Idet that flows through PMOS transistor P2 of current detection circuit 16 decreases according to Equation (2) given above. That is, because the electric current that is input to NMOS transistor N1 of first current mirror 100 of current bias circuit 15 decreases, the voltage of node VM decreases, and the on-resistance of NMOS transistor N2 increases accordingly. The increase in the on-resistance of NMOS transistor N2 increases the voltage of node VS. When the voltage of node VS reaches a voltage at which NMOS transistor N2 operates in a saturation region, current IN2 satisfies Equation (3) given above. When the voltage of node VS increases to be higher than the threshold voltage of NMOS transistors N3 and N4 of second current mirror 101 of current bias circuit 15, current IN3 that flows through NMOS transistor N3 increases gradually. In response to the decrease of current IN2, current IN3 increases so as to satisfy Equation (5) given above, and output bias current Ibias increases so as to satisfy Equation (4) given above.

When load current Iload reaches zero, in the case where output bias current Ibias in the unloaded state (Iload=0) shown in FIG. 2 is set to be equal to output bias current Ibias of the conventional regulator circuit (=IL0), output voltage VOUT of regulator circuit 200 reaches a level equal to that of the conventional regulator circuit.

FIG. 3 shows a property example in the case where output bias current Ibias in the unloaded state (Iload=0) is set to be greater than output bias current Ibias (=IL0) of NMOS transistor 204 of the conventional regulator circuit, and output bias current Ibias becomes zero when load current Iload is maximum (=IL3).

As is also clear from Equation (7) given above, by changing the aforementioned design parameters (k, m, n, I1, and Irdiv), it is possible to adjust output bias current Ibias in the unloaded state, the amount of change in output bias current Ibias relative to the change in load current Iload (output bias current–the slope of load current properties), and load current Iload at which output bias current Ibias reaches zero. When adjusting output bias current–load current properties, it is unnecessary to change all of the aforementioned design parameters (k, m, n, I1, and Irdiv) of Equation (7) given above.

As indicated by the relationship between output voltage VOUT and load current Iload in FIG. 3, by setting output bias current Ibias in the unloaded state (Iload=0) to be greater than current IL0, output voltage VOUT in the unloaded state can be set to a value lower than the level of the output voltage of the conventional regulator circuit. On the other hand, by setting output bias current Ibias at which load current Iload is maximum (=IL3) to zero, the drop in output voltage VOUT caused by output bias current Ibias can be avoided. Accordingly, the variation of output voltage VOUT relative to the change in load current Iload can be further reduced as compared with the property example shown in FIG. 2.

At load current Iload (=IL2) at which output bias current Ibias is current IL0, output voltage VOUT reaches a level equal to the output voltage of the conventional regulator circuit.

The operations of regulator circuit 200 performed when load current Iload increases or decreases are the same as those described with reference to FIG. 2. Accordingly, a description thereof is omitted here.

As described above, it is possible to suppress the variation of output voltage VOUT relative to the change in load current Iload, and also avoid the drop in output voltage VOUT even when load current Iload is large.

As explained above, regulator circuit 200 according to Embodiment 1 includes: voltage detection circuit 10 that detects a magnitude of an output voltage of an output node, and outputs a feedback voltage that indicates a result of the detection; error amplifier circuit 11 that compares the feedback voltage with a reference voltage, and outputs a voltage that indicates a result of the comparison; output circuit 12 that supplies an output current to the output node according to the output voltage of error amplifier circuit 11; current detection circuit 16 that detects a magnitude of the output current; and current bias circuit 15 that supplies an output bias current to the output node, and increases or decreases the output bias current based on a result of the detection of current detection circuit 16.

With this configuration, it is possible to suppress the output voltage variation relative to the change in the load current, and also suppress the drop in the output voltage even when the load current is large.

Here, current bias circuit 15 may decrease the output bias current if the result of the detection of current detection circuit 16 indicates an increase in the output current, and increase the output bias current if the result of the detection of current detection circuit 16 indicates that a decrease in the output current.

By increasing or decreasing the output bias current according to the increase or decrease of the output current, it is possible to suppress the output voltage variation relative to the change in the load current, and also suppress the drop in the output voltage even when the load current is large.

Here, current detection circuit 16 may output a detection current that is proportional to the output current. Current bias circuit 15 may include current source I1 that allows a constant current to flow therethrough. The constant current that flows through current source I1 may be a sum of the detection current or a first current that is proportional to the detection current and the output bias current or a second current that is proportional to the output bias current.

With this configuration, by using a simple circuit that includes a current source that allows a constant current to flow therethrough, it is possible to easily perform control so as to increase and decrease the output bias current.

Here, the constant current that flows through current source I1 may be a sum of the first current and the second current. Current bias circuit 15 may include: first current mirror 100 that receives an input of the detection current, and outputs the first current; and second current mirror 101 that receives an input of the second current and outputs the output bias current.

With this configuration, current bias circuit 15 is constituted by a combination of a current source, and first and second current mirrors. By appropriately setting the voltage of the power supply node that is connected to current bias circuit 15, the power consumption of the regulator circuit can be suppressed.

Here, current bias circuit 15 may include: first current source I1 that includes a first terminal and a second terminal, the first terminal being connected to an arbitrary power supply node or ground node; first current mirror 100 that includes an input terminal that is connected to an output terminal of current detection circuit 16, and an output terminal that is connected to the second terminal of first current source I1; and second current mirror 101 that includes an input terminal that is connected to the second terminal of first current source I1, and an output terminal that is connected to the output node.

With this configuration, by appropriately setting the voltage of the power supply node that is connected to current bias circuit 15, the power consumption of the regulator circuit can be suppressed.

Here, current detection circuit 16 may be a circuit that has the same configuration as the configuration of output circuit 12 except that the current driving capability is different, and may output the detection current that is proportional to the magnitude of the output current according to the output voltage of error amplifier circuit 11.

With this configuration, as indicated by Equation (2), current detection circuit 16 can easily generate the detection current that is proportional to the output current. Also, the increase of the operational lower limit voltage can be suppressed as compared with the case where current detection circuit 16 is configured as a current detection resistor that is connected in series to output circuit 12.

Here, current detection circuit 16 may be provided in parallel to output circuit 12.

With this configuration, the increase of the operational lower limit voltage can be suppressed as compared with the case where current detection circuit 16 is configured as a current detection resistor that is connected in series to output circuit 12.

Embodiment 2

Figure 4:
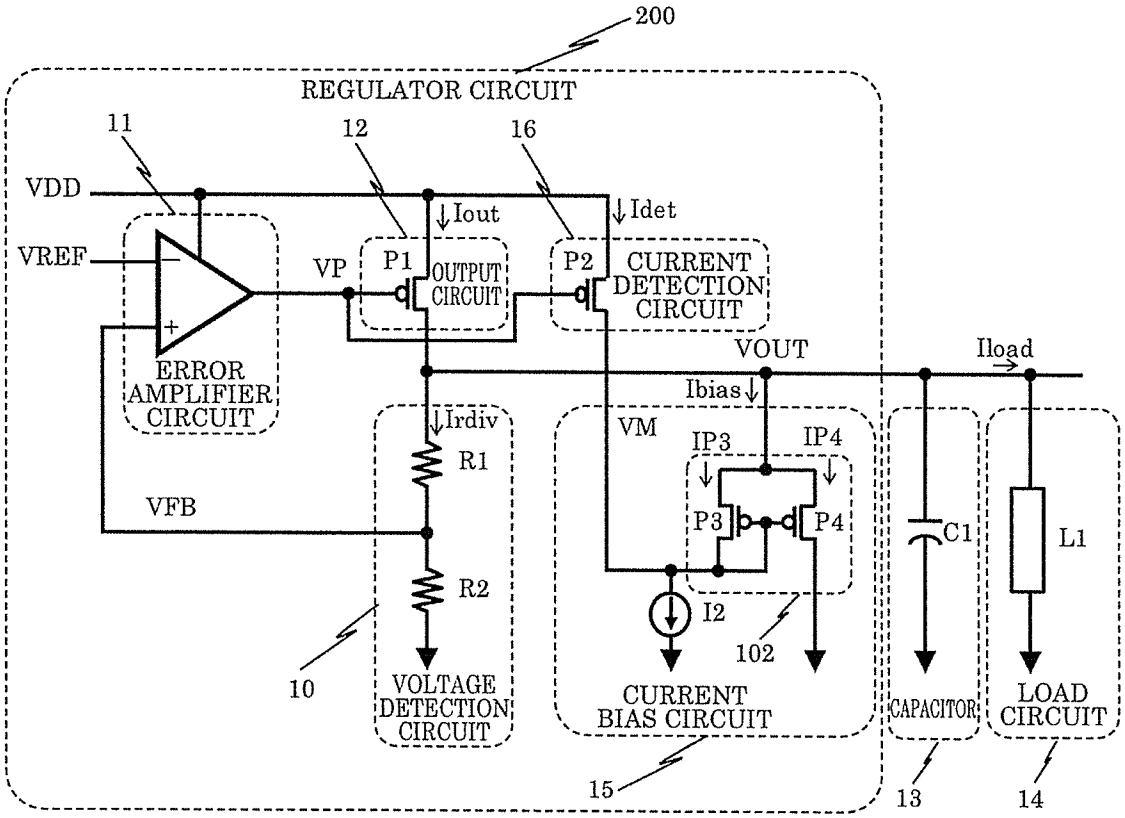
FIG. 4 is a diagram showing a configuration example of a regular circuit according to Embodiment 2, and peripheral circuits of the regular circuit.

FIG. 4 is a diagram showing a configuration example of regulator circuit 200 according to Embodiment 2, and peripheral circuits of the regular circuit. In FIG. 4, structural elements that have the same functions as those of regulator circuit 200 according to Embodiment 1 described above are given the same reference numerals, and a detailed description thereof is omitted. Only differences will be described here.

Regulator circuit 200 shown in FIG. 4 has the same configuration as that of regulator circuit 200 shown in FIG. 1, except that current bias circuit 15 of regulator circuit 200 shown in FIG. 1 has been replaced by current bias circuit 15 shown in FIG. 4.

Current bias circuit 15 according to Embodiment 2 is composed of second current source I2 and third current mirror 102. Current bias circuit 15 includes an input terminal that is connected to node VM that is the output terminal of current detection circuit 16, and an output terminal that is connected to output node VOUT.

When current bias circuit 15 receives an input of detection current Idet of current detection circuit 16 via node VM, current bias circuit 15 outputs output bias current Ibias to output node VOUT as a sink current.

Second current source I2 includes a third terminal that is connected to a ground node and a fourth terminal that is connected to node VM that is the output terminal of current detection circuit 16. Third current mirror 102 includes an input terminal that is connected to node VM, an output terminal that is connected to a ground node, and a source that is connected to output node VOUT.

Third current mirror 102 is composed of PMOS transistors P3 and P4. PMOS transistor P3 includes a gate and a drain that are commonly connected to node VM (input), and a source that is connected to output node VOUT (source). On the other hand, PMOS transistor P4 includes a gate that is connected to node VM that is common to the gate of PMOS transistor P3, a drain that is connected to a ground node (output), and a source that is connected to output node VOUT (source).

The voltage of the substrate node of PMOS transistors P3 and P4 may be set to a voltage that is not lower than the voltage of node VM within a range that is greater than or equal to output voltage VOUT and less than or equal to the voltage of power supply node VDD. Also, particularly when output voltage VOUT is variable in a wide range, the voltage of the substrate node of PMOS transistors P3 and P4 may be switched according to the level of output voltage VOUT, such that the voltage of the substrate node of PMOS transistors P3 and P4 is set to a low voltage when output voltage VOUT is low, and set to a high voltage when output voltage VOUT is high. The substrate node of PMOS transistors P3 and P4 may be connected to power supply node VDD or output node VOUT.

Here, if it is assumed that the size ratio of PMOS transistors P3 and P4 is 1:p, the relationship between current IP3 that flows through PMOS transistor P3 and current IP4 that flows through PMOS transistor P4 when PMOS transistor P4 operates in a saturation region can be represented by the following Equation (8).

$$IP4=p\times IP3 \tag{8}$$

Also, output bias current Ibias is a sum of the electric current that flows through PMOS transistor P3 and the electric current that flows through PMOS transistor P4, and thus output bias current Ibias can be represented by the following Equation (9).

$$I\text{bias}=IP3+IP4 \tag{9}$$

From the relationship of the electric current at node VM, the relationship between detection current Idet, current I2 that flows through second current source I2, and current IP3 that flows through PMOS transistor P3 can be represented by the following Equation (10).

$$I2=I\text{det}+IP3 \tag{10}$$

Accordingly, from the Equations (8) to (10) given above, the relationship between detection current Idet and output bias current Ibias can be represented by the following Equation (11).

$$I2=I\text{det}+I\text{bias}/(1+p) \tag{11}$$

In Equation (11) given above, the left-hand side is current I2 of second current source I2, and the right-hand side is a sum of detection current Idet and the second current that is proportional to output bias current Ibias. That is, current bias circuit 15 performs operation such that, when current I2 of second current source I2, when it is set to an arbitrary constant value, is equal to a sum of detection current Idet and the second current that is proportional to output bias current Ibias.

In this example, current I2 of second current source I2 is set to an arbitrary constant value. However, by setting current I2 of second current source I2 to a different arbitrary constant value according to the operation mode (switching of power supply voltage, load current, output voltage, and the like) of regulator circuit 200, it is possible to reduce unnecessary current consumption according to the specifications and application of regulator circuit 200.

Because regulator circuit 200 is configured as described above, regulator circuit 200 satisfies Equations (1), (2), and (8) to (11) given above.

Accordingly, from Equations (1), (2), and (8) to (11) given above, output bias current Ibias can be represented by the following Equation (12), and the dependency of output bias current Ibias on load current Iload can be adjusted by the transistor size ratio (k, p), current I2 of second current source I2, and current Irdiv that flows through voltage detection circuit 10.

$$I\text{bias}=((1+p)/(1+k+p))\times(k\times I2-Ir\ \text{div}-I\text{load}) \tag{12}$$

Next, the operations of regulator circuit 200 will be described focusing on the operations of current bias circuit 15 because regulator circuit 200 has the same configuration as that of Embodiment 1 except for current bias circuit 15.

When detection current Idet increases along with an increase of load current Iload, because current I2 of second current source I2 is set to an arbitrary constant value, the voltage of node VM increases so as to satisfy Equation (10) given above. As a result, the gate-to-source voltage of PMOS transistor P3 decreases, and current IP3 that flows through PMOS transistor P3 decreases. Because the gate of PMOS transistor P4 is common to that of PMOS transistor P3, as output bias current Ibias, the electric current (IP4=p× IP3) that corresponds to the transistor size ratio is combined with current IP3 that flows through PMOS transistor P3, and is allowed to flow from output node VOUT as a sink current, as indicated by Equation (9) given above. When detection current Idet further increases, and a difference between output voltage VOUT and the voltage of node VM reaches a value that is less than or equal to the threshold voltage of PMOS transistors P3 and P4, PMOS transistors P3 and P4 operate in a sub-threshold region. Accordingly, PMOS transistors P3 and P4 are brought into a substantially off state, and output bias current Ibias reaches substantially zero. When the voltage of node VM reaches output voltage VOUT, PMOS transistors P3 and P4 are turned off, and output bias current Ibias reaches zero. On the other hand, when load current Iload decreases, detection current Idet decreases. Accordingly, the voltage of node VM decreases. As a result, the gate-to-source voltage of PMOS transistor P3 increases accordingly, current IP3 and current IP4 increase, and output bias current Ibias increases.

The level of output voltage VOUT in the unloaded state is determined according to the setting of output bias current Ibias when load current Iload is zero. Accordingly, by setting output bias current Ibias in the unloaded state (Iload=0) in the same manner as in Embodiment 1, and setting the output bias current when the load current is maximum to zero, it is possible to obtain the same variation of output voltage VOUT as in Embodiment 1.

Accordingly, as in Embodiment 1, it is possible to suppress the variation of output voltage VOUT relative to the change in load current Iload, and also avoid the drop in output voltage VOUT even when load current Iload is large.

Furthermore, as described above, current bias circuit 15 is composed of second current source I2 and third current mirror 102, and it is therefore possible to reduce the number of elements and the area as compared with the configuration according to Embodiment 1.

Also, because the source of third current mirror 102 is connected to output node VOUT, there is no unnecessary current consumption except for detection current Idet, and thus the consumption current can be reduced as compared with the configuration according to Embodiment 1.

As described above, in regulator circuit 200 according to Embodiment 2, current detection circuit 16 outputs a detection current that is proportional to the output current, current bias circuit 15 includes current source I2 that allows a constant current to flow therethrough, and the constant current that flows through current source I2 is a sum of the detection current or a first current that is proportional to the detection current and the output bias current or a second current that is proportional to the output bias current.

Here, the constant current that flows through the current source may be a sum of the detection current and the second current, and current bias circuit 15 may include current mirror 102 that receives an input of the second current, outputs a mirror current that is proportional to the second current, is connected to the output node, and supplies a sum of the second current and the mirror current to the output node as the output bias current.

With this configuration, current bias circuit 15 is composed of a combination of a current source and a current mirror. Current bias circuit 15 can be configured by using a less number of elements, and the circuit area within an IC can be reduced as compared with Embodiment 1.

Here, current bias circuit 15 may include: second current source I2 that includes a third terminal that is connected to an arbitrary power supply node or a ground node, and a fourth terminal that is connected to an output terminal of the current detection circuit; and current mirror 102 that includes an input terminal that is connected to the fourth terminal of the second current source, an output terminal that is connected to an arbitrary power supply node or ground node, and a source that is connected to the output node.

With this configuration, current bias circuit 15 can be configured by using a less number of elements, and the circuit area within an IC can be reduced as compared with Embodiment 1.

Embodiment 3

Figure 5:
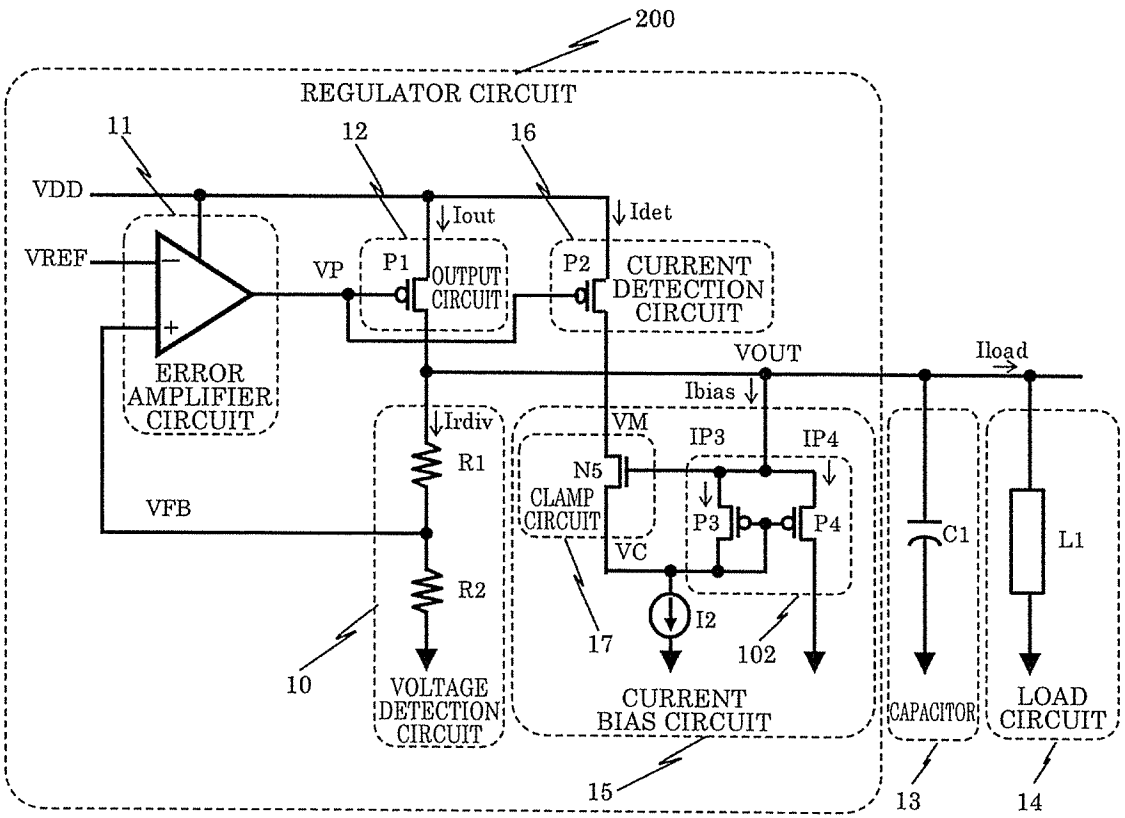
FIG. 5 is a diagram showing a configuration example of a regular circuit according to Embodiment 3, and peripheral circuits of the regular circuit.

FIG. 5 is a diagram showing a configuration example of regulator circuit 200 according to Embodiment 3, and peripheral circuits of the regular circuit. In FIG. 5, structural elements that have the same functions as those of regulator circuit 200 according to Embodiment 2 described above are given the same reference numerals, and a detailed description thereof is omitted. Only differences will be described here.

Regulator circuit 200 shown in FIG. 5 has the same configuration as that of regulator circuit 200 shown in FIG. 4, except that current bias circuit 15 of regulator circuit 200 shown in FIG. 4 has been replaced by current bias circuit 15 shown in FIG. 5.

Current bias circuit 15 according to Embodiment 3 is composed of second current source I2, third current mirror 102, and clamp circuit 17, and has a configuration in which clamp circuit 17 is further included in current bias circuit 15 according to Embodiment 2. Current bias circuit 15 includes an input terminal that is connected to node VM that is the output terminal of current detection circuit 16, and an output terminal that is connected to output node VOUT.

Current bias circuit 15 receives an input of detection current Idet of current detection circuit 16 via node VM, and outputs output bias current Ibias to output node VOUT as a sink current.

Second current source I2 includes a third terminal that is connected to a ground node, and a fourth terminal that is connected to node VC. Third current mirror 102 includes an input terminal that is connected to node VC, an output terminal that is connected to a ground node, and a source that is connected to output node VOUT. Clamp circuit 17 includes a first input terminal that is connected to node VM that is the output terminal of current detection circuit 16, a second input that is connected to output node VOUT, and a first output terminal that is connected to node VC.

Third current mirror 102 is composed of PMOS transistors P3 and P4. PMOS transistor P3 includes a gate and a drain that are commonly connected to node VC (input), and a source that is connected to output node VOUT (source). On the other hand, PMOS transistor P4 includes a gate that is connected to node VC that is common to the gate of PMOS transistor P3, a drain that is connected to a ground node (output), and a source that is connected to output node VOUT (source).

Clamp circuit 17 is composed of NMOS transistor N5. Clamp circuit 17 includes a first input terminal that is connected to a drain of NMOS transistor N5, a second input terminal that is connected to a gate of NMOS transistor N5, and a first output terminal that is connected to a source of NMOS transistor N5.

In the case where a difference between the voltage of power supply node VDD and output voltage VOUT is large, or output voltage VOUT is variable, and a voltage from a low voltage to a high voltage is output (the case where the difference between the voltage of power supply node VDD and output voltage VOUT is small and the case where the difference between the voltage of power supply node VDD and output voltage VOUT is large are mixed), if the substrate node of PMOS transistors P3 and P4 of third current mirror 102 is connected to power supply node VDD, due to an increase of the threshold voltage by the substrate bias effect, the level of output voltage VOUT at which current bias circuit 15 can perform operation increases, allowing a problem in that the lower limit voltage of output voltage VOUT is limited. On the other hand, if the substrate node of PMOS transistors P3 and P4 of third current mirror 102 is connected to output node VOUT, the drain voltage of PMOS transistor P3 increases due to an increase of detection current Idet. When the drain voltage of PMOS transistor P3 exceeds output voltage VOUT of output node VOUT, a forward bias occurs between the drain and the substrate node of PMOS transistor P3, and electric current flows into output node VOUT. In the case where PMOS transistor P3 is formed in an N-type well on a P-type substrate, a parasitic bipolar transistor is formed by the drain, the substrate node (N-type well), and the P-type substrate of PMOS transistor P3. When the parasitic bipolar transistor performs operation, electric current flows into the P-type substrate, which may cause latch-up or the like due to the increase of the potential of the P-type substrate, and cause a problem in that consideration needs to be given to the layout.

Clamp circuit 17 is provided to solve the problem described above. Clamp circuit 17 limits the voltage of node VC (the drain voltage of PMOS transistor P3) such that it does not exceed output voltage VOUT even when the substrate node of PMOS transistors P3 and P4 of third current mirror 102 is connected to output node VOUT and set to output voltage VOUT.

Because regulator circuit 200 is configured as described above, current IN5 that flows through NMOS transistor N5 is equal to detection current Idet, and as in Embodiment 2, Equations (1), (2), and (8) to (12) given above are satisfied, the dependency of output bias current Ibias on load current Iload can be adjusted by the transistor size ratio (k, p), current I2 of second current source I2, and current Irdiv that flows through voltage detection circuit 10.

Next, the operations of regulator circuit 200 will be described focusing on the operations and actions of clamp circuit 17 provided in current bias circuit 15 because regulator circuit 200 has the same configuration as that of Embodiment 2 except for clamp circuit 17 provided in current bias circuit 15.

Figure 6:
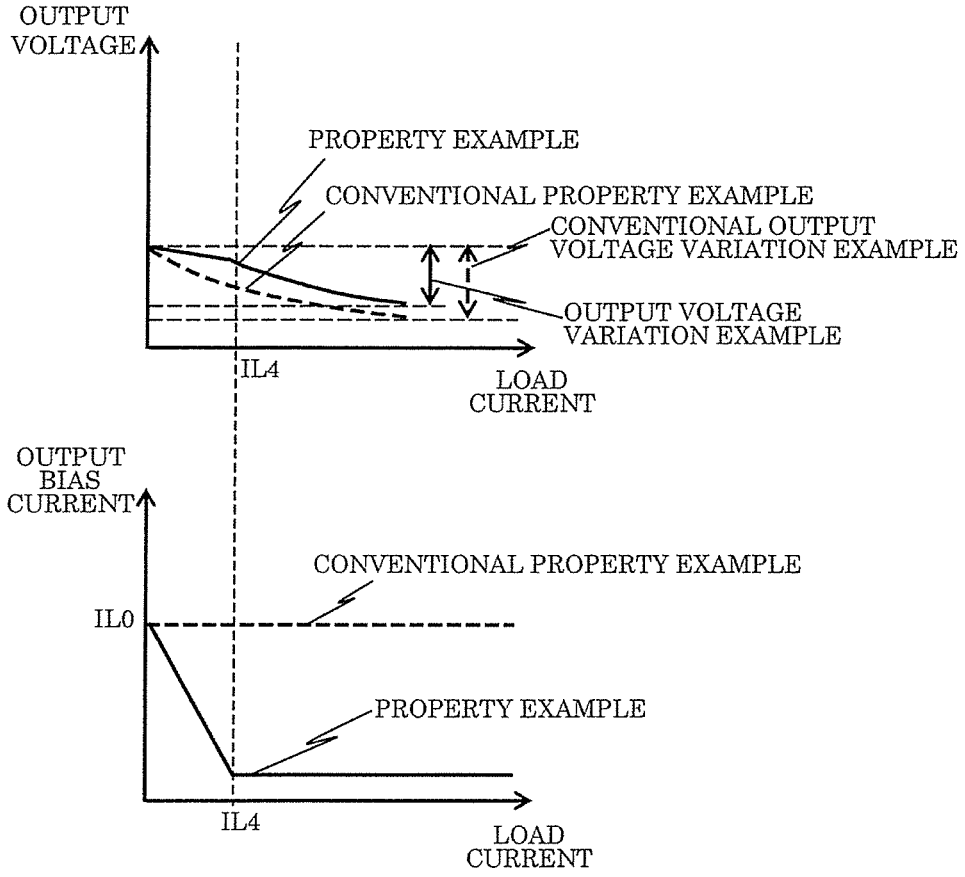
FIG. 6 is a diagram showing a property example of the regulator circuit according to Embodiment 3.

FIG. 6 is a diagram showing a property example of regulator circuit 200 according to Embodiment 3. In FIG. 6, the solid lines indicate properties when output bias current Ibias is allowed to flow from output node VOUT by current bias circuit 15 of regulator circuit 200 according to Embodiment 3. On the other hand, the dotted lines indicate properties when constant output bias current Ibias (=IL0) is allowed to flow from output VREG by NMOS transistor 204 of the above-described conventional regulator circuit.

When detection current Idet increases along with an increase of load current Iload, the voltages of node VM and node VC increase. Due to the increase of node VC, the gate-to-source voltage (a difference between output voltage VOUT and the voltage of node VC) of PMOS transistors P3 and P4 decreases, and current IP3 that flows through PMOS transistor P3 decreases. In response thereto, current IP4 that flows through PMOS transistor P4 also decreases, and output bias current Ibias decreases. The increase of the voltage of node VC also decreases the gate-to-source voltage of NMOS transistor N5 at the same time. The voltage of node VC is limited by output voltage VOUT-Vt (the threshold voltage of NMOS transistor N5) that is the gate voltage of NMOS transistor N5, and is limited by a maximum voltage that satisfies Equation (10) given above. Accordingly, even when load current Iload increases more than that (load current Iload=IL4), the voltage of node VC does not increase, and detection current Idet is saturated. Because detection current Idet is saturated and becomes constant, as indicated by Equation (11) given above, constant output bias current Ibias that is determined by current I2 of second current source I2, saturated detection current Idet, and transistor size ratio (p) is allowed to flow. When output voltage VOUT drops due to the subsequent increase of load current Iload, the voltage of node VC also decreases so as to keep the gate-to-source voltage of NMOS transistor N5. At this time, the gate-to-source voltage of PMOS transistors P3 and P4 is also kept at the same time, and thus output bias current Ibias is kept constant.

The voltage of node VC does not reach output voltage VOUT in a state in which the voltage is limited by NMOS transistor N5 of clamp circuit 17. Accordingly, as shown in FIG. 6, output bias current Ibias that is smaller than output bias current Ibias in the unloaded state Ibias (=IL0) but is constant even when load current Iload is large is allowed to flow, and a drop in output voltage VOUT occurs.

On the other hand, when load current Iload decreases, operations are performed in a reverse manner to those described above. Output bias current Ibias is kept constant until detection current Idet decreases to a detectable level. When detection current Idet reaches the detectable level with output bias current Ibias being constant, the voltage of node VM and the voltage of node VC decrease along with the decrease of detection current Idet, the gate-to-source voltage of PMOS transistors P3 and P4 increases along with the decrease of the voltage of node VC, and output bias current Ibias increases.

Because the level of output voltage VOUT in the unloaded state is determined according to the setting of output bias current Ibias when load current Iload is zero, by setting output bias current Ibias in the unloaded state (Iload=0) in the same manner as in Embodiment 1, it is possible to obtain the same output voltage VOUT as in Embodiment 1. On the other hand, with respect to the output bias current when the load current is maximum, as described above, because a constant current that corresponds to saturated detection current Idet, current I2 of second current source I2, and transistor size ratio (p) shown in Equation (11) given above flows, a drop in output voltage VOUT that corresponds to the output bias current value occurs. However, the drop in the output voltage can be suppressed as compared with the conventional regulator circuit.

Accordingly, it is possible to suppress the variation of output voltage VOUT relative to the change in load current Iload, and also suppress the drop in output voltage VOUT when the load current is large.

The foregoing has been described using a configuration in which clamp circuit 17 is composed of NMOS transistor N5. However, in clamp circuit 17, by using a circuit that uses, as the limitation voltage of node VC, a voltage level at which PMOS transistors P3 and P4 operate in a sub-threshold region or output voltage VOUT, output bias current Ibias when load current Iload is large can be set to substantially zero or zero, and the drop in output voltage VOUT can be avoided.

Figure 7:
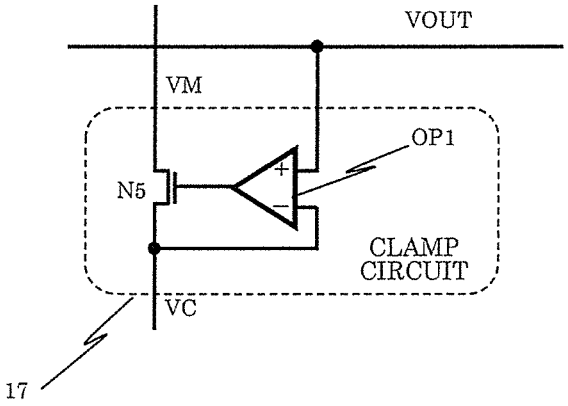
FIG. 7 is a diagram showing another circuit configuration example that can be applied to a clamp circuit.

FIG. 7 is another circuit configuration example that can be applied to clamp circuit 17. By using the configuration of clamp circuit 17 shown in FIG. 7, the output bias current can be set to zero when the load current is large. Clamp circuit 17 may be configured in this way.

The configuration and operations of clamp circuit 17 shown in FIG. 7 are known as a common technique, and thus a detailed description will be omitted. Hereinafter, only the connection configuration and advantages when clamp circuit 17 is applied to Embodiment 3 will be described.

Clamp circuit 17 shown in FIG. 7 is composed of NMOS transistor N5 and operational amplifier OP1. A drain of NMOS transistor N5 is connected to a first input terminal (node VM), a non-inverting input terminal of operational amplifier OP1 is connected to a second input terminal (output node VOUT), and an inverting input terminal of the operational amplifier and a source of NMOS transistor N5 are connected to a first output terminal (node VC). With the configuration described above, the voltage of node VC can be limited by output voltage VOUT of output node VOUT, and thus output bias current Ibias can be set to zero when load current Iload is large. It is therefore possible to avoid the drop in output voltage VOUT.

As described above, current detection circuit 16 of regulator circuit 200 according to Embodiment 3 outputs a detection current that is proportional to the output current. Current bias circuit 15 includes current source I2 that allows a constant current to flow therethrough. The constant current that flows through current source I2 is a sum of the detection current or a first current that is proportional to the detection current and the output bias current or a second current that is proportional to the output bias current.

Here, the constant current that flows through the current source may be a sum of the detection current and the second current. Current bias circuit 15 may include current mirror 102 that receives an input of the second current, outputs a mirror current that is proportional to the second current, is connected to the output node, and supplies a sum of the second current and the mirror current to the output node as the output bias current.

Here, current bias circuit 15 may include clamp circuit 17 that is provided in a wire that transmits the detection current from current detection circuit 16 to the current source, and limits a voltage of a portion of the wire that is on the current source side such that the voltage does not exceed the output voltage.

With this configuration, it is possible to alleviate the limitation of the lower limit voltage of output voltage VOUT. Also, the voltage of node VC can be limited such that the voltage of node VC does not exceed output voltage VOUT, and it is therefore possible to prevent a malfunction caused by latch-up due to the parasitic bipolar transistor.

Here, current bias circuit 15 may further include clamp circuit 17 that includes a first input terminal that is connected to the output terminal of current detection circuit 16, a second input terminal that is connected to the output node, and a first output terminal that is connected to the fourth terminal of the second current source and the input terminal of current mirror 102, the clamp circuit being configured to limit a potential of the first output terminal.

With this configuration, it is possible to alleviate the limitation of the lower limit voltage of output voltage VOUT. Also, the voltage of node VC can be limited such that the voltage of node VC does not exceed output voltage VOUT, and it is therefore possible to prevent a malfunction caused by latch-up due to the parasitic bipolar transistor.

In the foregoing, a case has been described in which third current mirror 102 of current bias circuit 15 is composed of PMOS transistors, and clamp circuit 17 is composed of a NMOS transistor. However, as shown in Embodiment 5, which will be described later, in the present embodiment as well, the PMOS transistors may be replaced by NMOS transistors, and the NMOS transistor may be replaced by a PMOS transistor. In this case, the sources of the NMOS transistors that constitute third current mirror 102 may be connected to output node VOUT, and the substrate nodes may also be connected to output node VOUT. By connecting the gate of a PMOS transistor that constitutes clamp circuit 17 to VOUT, the source of the PMOS transistor that serves as a common node to the input terminal of third current mirror 102 can be limited to output voltage VOUT+Vt (the threshold voltage of the PMOS transistor), and it is therefore possible to prevent the forward bias between the drain and the substrate node of the NMOS transistors. That is, clamp circuit 17 is configured to perform operation so as to perform control such that the potential of the first output terminal does not fall below output voltage VOUT. In other words, in the case of a configuration in which the PMOS transistors are replaced by NMOS transistors and the NMOS transistor is replaced by a PMOS transistor, the expression "the voltage of node VC does not exceed output voltage VOUT" should be understood to read as: the voltage of node VC does not fall below output voltage VOUT.

Embodiment 4

Figure 8:
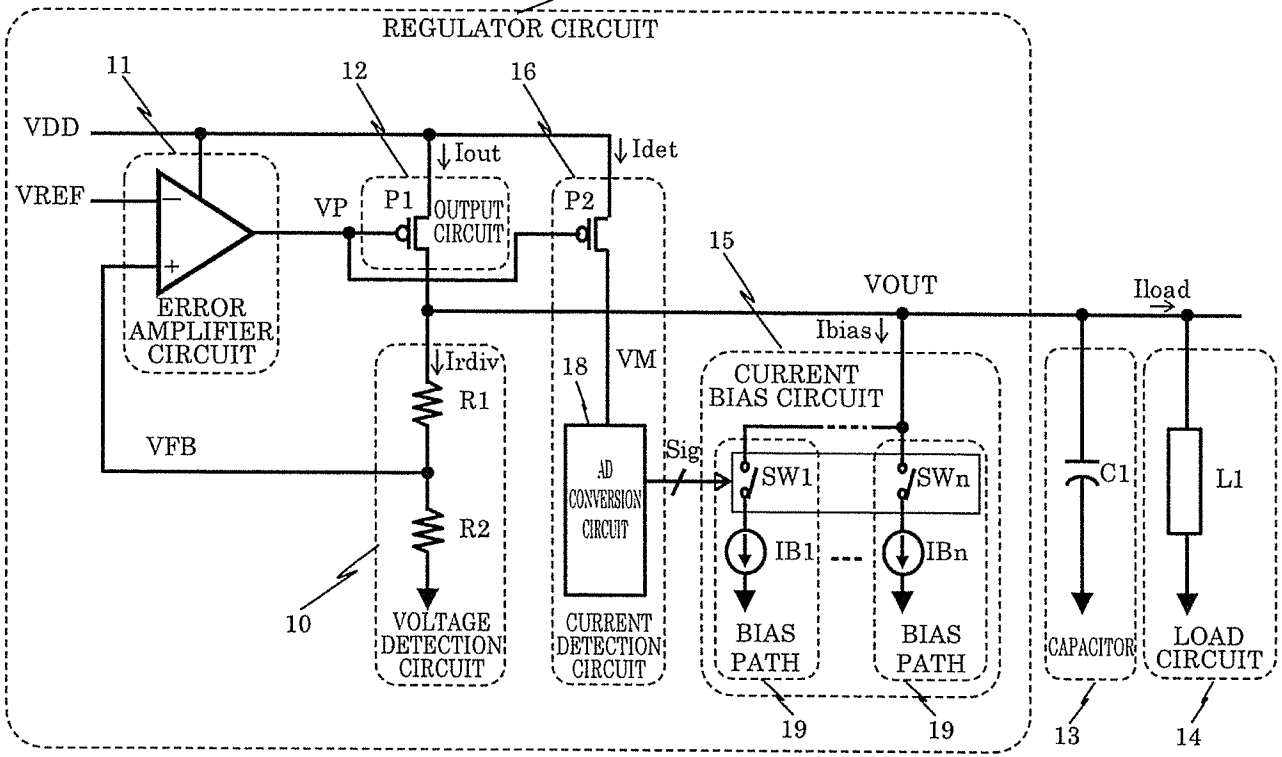
FIG. 8 is a diagram showing a configuration example of a regular circuit according to Embodiment 4, and peripheral circuits of the regular circuit.

FIG. 8 is a diagram showing a configuration example of regulator circuit 200 according to Embodiment 4, and peripheral circuits of the regular circuit. In FIG. 8, structural elements that have the same functions as those of regulator circuit 200 according to Embodiment 1 described above are given the same reference numerals, and a detailed description thereof is omitted. Only differences will be described here.

Regulator circuit 200 shown in FIG. 8 has the same configuration as that of regulator circuit 200 shown in FIG. 1, except that current bias circuit 15 of regulator circuit 200 shown in FIG. 1 has been replaced by current bias circuit 15 shown in FIG. 8, and current detection circuit 16 of regulator circuit 200 shown in FIG. 1 has been replaced by current detection circuit 16 shown in FIG. 8.

Current bias circuit 15 according to Embodiment 4 is composed of n (where n is an integer of 1 or more) bias paths 19, with its input terminal being connected to the output terminal of current detection circuit 16 so as to receive an input of n-bit signals Sig for switching n bias paths 19 between on and off. n-bit signals Sig are assigned to n bias paths in one-to-one correspondence. As the output, first terminals of n bias paths 19 are connected to output node VOUT, and second terminals of n bias paths 19 are connected to a ground node.

Switches SWn (where n is an integer of 1 or more) are connected to the first terminals of bias paths 19. Current sources IBn (where n is an integer of 1 or more) that are each set to a predetermined current value are connected in series to switches SWn. The other terminals of current sources IBn are connected to the second terminals of bias paths 19, and are grounded. Switches SWn are controlled by any one bit of n-bit input signals Sig, and are configured to be turned on when the bit is set to "L", and turned off when the bit is set to "H". The predetermined current value set in each of current sources IBn is set to a current value of 1/n with respect to output bias current Ibias IL0) set in the unloaded state. Accordingly, in each bias path 19, a corresponding bit of input signal Sig is set to "L", switch SWn is turned on so as to allow a corresponding output bias current to flow from output node VOUT (IL0/n). When the corresponding bit of input signal Sig is set to "H", switch SWn is turned off so as to perform operation to not allow the output bias current to flow from output node VOUT.

Current detection circuit 16 according to Embodiment 4 is composed of PMOS transistor P2 and AD conversion circuit 18.

PMOS transistor P2 includes a gate that is connected to output VP of error amplifier circuit 11, a source that is connected to power supply node VDD, and a drain that is connected to an input terminal (node VM) of AD conversion circuit 18. PMOS transistor P2 outputs detection current Idet that flows through PMOS transistor P2 to AD conversion circuit 18. Here, if it is assumed that the transistor size ratio of PMOS transistor P2 to PMOS transistor P1 of output circuit 12 is the same as that of Embodiment 1, Equation (2) given above is satisfied.

AD conversion circuit 18 includes an input terminal that is connected to the drain (node VM) of PMOS transistor P2, and performs AD conversion on the amount of detection current Idet that has been input. AD conversion circuit 18 outputs, to current bias circuit 15, n-bit signals Sig with an increased number of "H" outputs as the current value of detection current Idet is higher.

Figure 9:
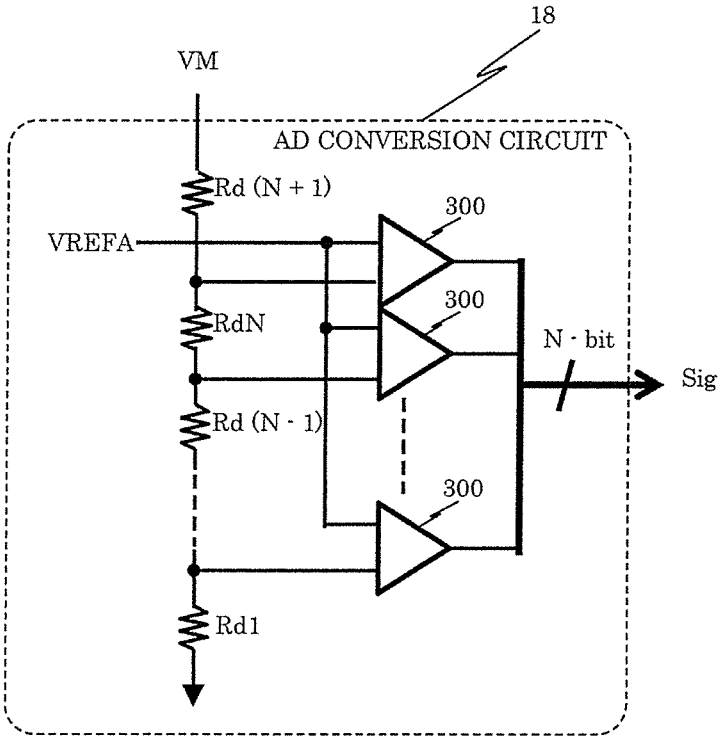
FIG. 9 is a diagram showing a configuration example of an AD conversion circuit.

FIG. 9 shows a circuit configuration example of AD conversion circuit 18. As shown in FIG. 9, AD conversion circuit 18 can be composed of (n+1) resistors Rd1 to Rd (N+1) that are connected in series between an input terminal (node VM) of AD conversion circuit 18 and a ground node and n comparators 300. At n connection points between (n+1) resistors, the voltage is compared with reference voltage VREFA by using n comparators 300, and thereby the magnitude of detection current Idet can be represented by an n-bit digital signal. If it is assumed that comparator 300 is configured to output "H" when the potential of a connection point between resistors is higher than reference voltage VREFA, the number of n-bit signals Sig that are set to "H" increases as the current value of detection current Idet is higher. Conversely, the number of n-bit signals Sig that are set to "H" decreases as the current value of detection current Idet is lower. AD conversion circuit 18 is known as a common technique, and thus a further detailed description thereof is omitted here.

Figure 10:
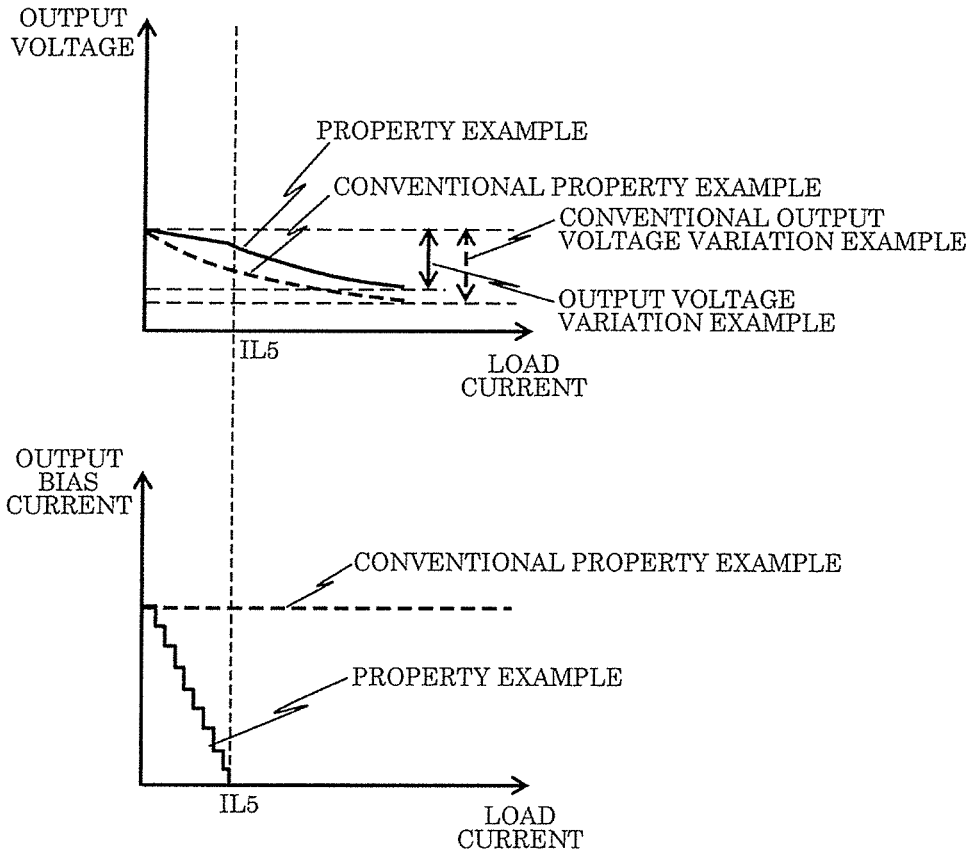
FIG. 10 is a diagram showing a property example of a regulator circuit according to Embodiment 4.

Next, the operations of regulator circuit 200 according to Embodiment 4 will be described. FIG. 10 is a diagram showing a property example of regulator circuit 200 according to Embodiment 4.

In FIG. 10, the solid lines indicate a property example of regulator circuit 200 according to Embodiment 4, and the dotted lines indicate a property example when constant output bias current Ibias (=IL0) is allowed to flow from output VREG by NMOS transistor 204 of the above-described conventional regulator circuit.

Regulator circuit 200 according to Embodiment 4 have the same configuration as those of the embodiments described above except for current bias circuit 15 and current detection circuit 16, and thus a description will be omitted.

Because regulator circuit 200 shown in FIG. 8 is configured as described above, when load current Iload increases, detection current Idet increases according to Equation (2) given above. Along with the increase of detection current Idet, the number of H" output bits of n-bit signals Sig output from AD conversion circuit 18 increases. Signals Sig are input to current bias circuit 15, a number of bias paths 19 that corresponds to the number of H" output bits are turned off, and output bias current Ibias decreases. Output bias current Ibias at this time can be represented by (q/n)×IL0, where q is the number of "L" bits. When the number of H" output bits from AD conversion circuit 18 increases along with the increase of detection current Idet due to the increase of load current Iload, as indicated by the relationship between output bias current and load current shown in FIG. 10, the output bias current decreases stepwise by a current value (IL0/n) of one bias path. On the other hand, when load current Iload decreases, detection current Idet also decreases, and the number of H" output bits from AD conversion circuit 18 decreases. Then, operation is performed such that the output bias current increases stepwise by a current value (IL0/n) of one bias path. The step difference of the output bias current becomes smaller as the resolution of AD conversion circuit 18 is higher.

The foregoing has been described using a configuration in which the output bias current in the unloaded state is set to match the constant output bias current (=IL0) from output VREG by NMOS transistor 204 of the conventional regulator circuit, but the output bias current in the unloaded state can be set arbitrarily.

As described above, during the unloaded state, by setting output bias current (=IL0) as in the conventional technology, it is possible to obtain an output voltage as in the conventional technology. When the load current is large, the output bias current can be set to zero by turning off all bias paths 19, and thus the variation of output voltage VOUT relative to the change in the load current can be suppressed, and the drop in the output voltage can be avoided even when the load current is large.

The current values set in current sources IB1 to IBn are not limited to 1/n of the output bias current that is set in the unloaded state, and may be set freely as appropriate according to the specifications and properties required, such as by weighting between steps.

As described above, in Embodiment 4, current detection circuit 16 may output a digital detection signal that indicates the magnitude of the output current. Current bias circuit 15 may include at least one bias path 19. Each of the at least one bias path 19 may include a current source that is set to a predetermined current value and a switch that is connected in series to the current source. Current bias circuit 15 may decrease the output bias current when the output current increases and increase the output bias current when the output current decreases by changing the number of switches that are turned on according to a change in the digital detection signal.

With this configuration, the output bias current is decreased or increased according to the change in the digital detection signal. Because the magnitude and accuracy of the output bias current are determined according to the current values of current sources IBn of bias paths 19, the resolution of AD conversion circuit 18, and the number of switches that are turned on, the design of the current value can be facilitated, the accuracy of control of the output bias current can be easily enhanced, and the accuracy of the output voltage can be improved.

Embodiment 5

Figure 11:
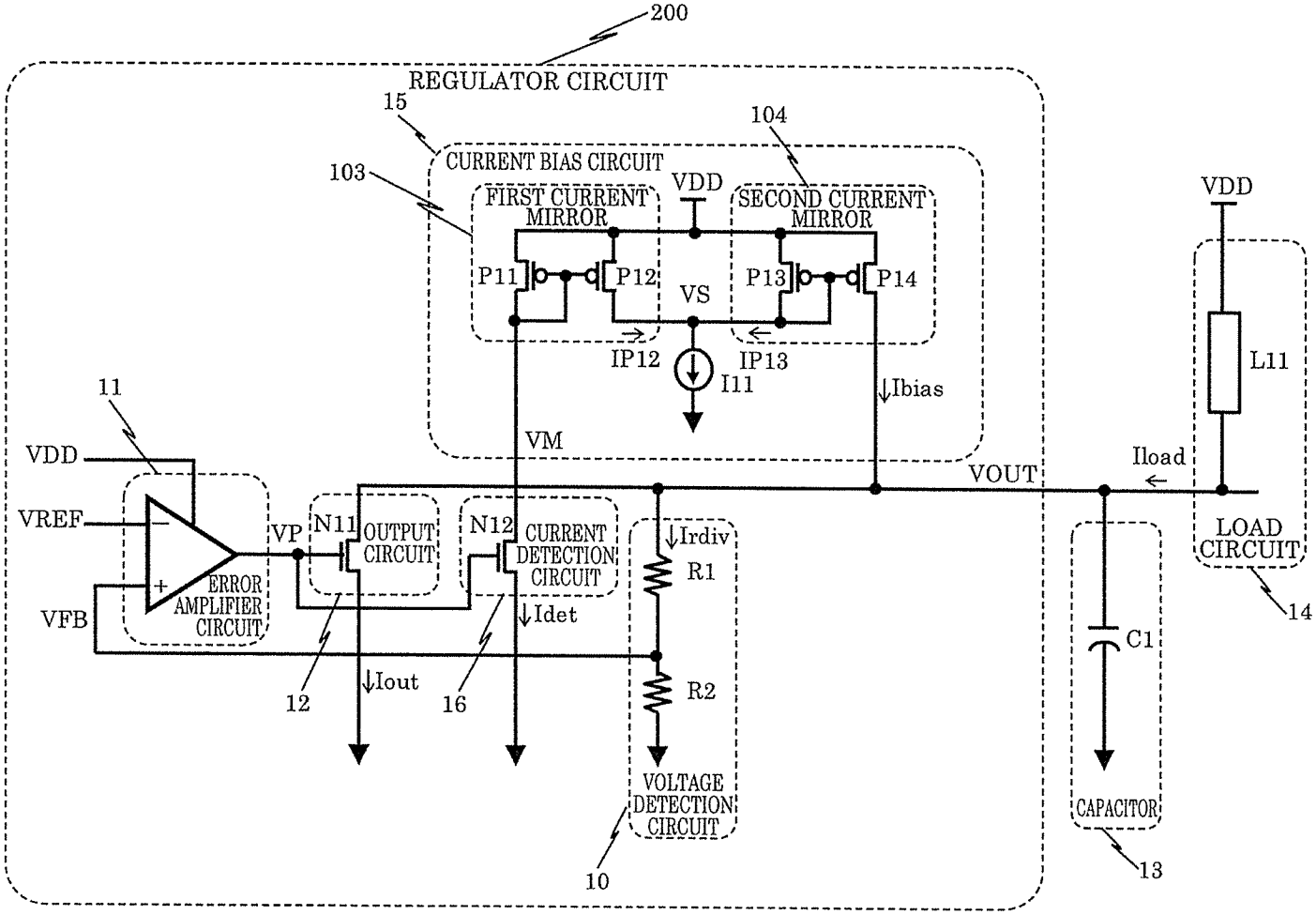
FIG. 11 is a diagram showing a configuration example of a regular circuit according to Embodiment 5, and peripheral circuits of the regular circuit.

FIG. 11 is a diagram showing a configuration example of regulator circuit 200 according to Embodiment 5, and peripheral circuits of the regular circuit.

Regulator circuit 200 shown in FIG. 11 includes: voltage detection circuit 10 that outputs feedback voltage VFB according to output voltage VOUT of output node VOUT; error amplifier circuit 11 that outputs voltage VP that indicates a result of comparison between reference voltage VREF and output voltage VFB of voltage detection circuit 10; output circuit 12 that supplies output current Iout to output node VOUT according to output voltage VP of error amplifier circuit 11; current detection circuit 16 that monitors output current Iout of output circuit 12, and outputs detection current Idet according to output current Iout; and current bias circuit 15 that controls output bias current Ibias according to detection current Idet of current detection circuit 16.

The regulator circuit according to Embodiment 5 is configured by changing the regulator circuit according to Embodiment 1 such that the PMOS transistors are replaced by NMOS transistors, and the NMOS transistors are replaced by PMOS transistors. Output current Iout serves as a sink current to output node VOUT, and the output bias current serves as a source current.

Voltage detection circuit 10 and error amplifier circuit 11 are structural elements that have the same functions as those of the above-described conventional regulator circuit, and thus a detailed description thereof is omitted here.

Output circuit 12 is composed of NMOS transistor N11. NMOS transistor N11 includes a gate that is connected to output VP of error amplifier circuit 11, a source that is connected to a ground node, and a drain that is connected to output node VOUT. Output circuit 12 supplies current Iout to output node VOUT as a sink current according to output voltage VP of error amplifier circuit 11.

Current detection circuit 16 is composed of NMOS transistor N12. NMOS transistor N12 includes a gate that is connected to output VP of error amplifier circuit 11, a source that is connected to a ground node, and a drain that is connected to node VM. Current detection circuit 16 outputs detection current Idet according to output current Iout of output circuit 12. Here, if it is assumed here that the size ratio of NMOS transistor N11 of output circuit 12 and NMOS transistor N12 of current detection circuit 16 is k:1, when NMOS transistors N11 and N12 operate in a saturation region, the relationship between detection current Idet and output current Iout satisfies Equation (2) given above.

Current bias circuit 15 is composed of first current source I11, first current mirror 103, and second current mirror 104. First current source I11 includes a first terminal that is connected to a ground node, and a second terminal that is connected to node VS. First current mirror 103 includes an input terminal that is connected to node VM, and an output terminal that is connected to node VS. Second current mirror 104 includes an input terminal that is connected to node VS, and an output terminal that is connected to output node VOUT.

Accordingly, current bias circuit 15 receives an input of detection current Idet of current detection circuit 16 via node VM, and outputs output bias current Ibias to output node VOUT as a source current.

First current mirror 103 is composed of PMOS transistors P11 and P12. PMOS transistor P11 includes a gate and a drain that are commonly connected to node VM (input), and a source that is connected to power supply node VDD. On the other hand, PMOS transistor P12 includes a gate that is connected to node VM that is common to the gate of PMOS transistor P11, a drain that is connected to node VS (output), and a source that is connected to power supply node VDD. Here, if it is assumed that the size ratio of PMOS transistors P11 and P12 is 1:m, when PMOS transistor P12 operates in a saturation region, the relationship between current IP12 that flows through PMOS transistor P12 and detection current Idet can be represented by Equation (13) given below. This corresponds to Equation (3) of Embodiment 1 described above.

$$IP12=m\times Idet \tag{13}$$

Second current mirror 104 is composed of PMOS transistors P13 and P14. PMOS transistor P13 includes a gate and a drain that are commonly connected to node VS (input), and a source that is connected to power supply node VDD. On the other hand, PMOS transistor P14 includes a gate that is connected to node VS that is common to the gate of PMOS transistor P13, a drain that is connected to output node VOUT (output), and a source that is connected to power supply node VDD. Here, if it is assumed that the size ratio of PMOS transistors P13 and P14 is 1:n, when PMOS transistor P14 operates in a saturation region, the relationship between current IP13 that flows through PMOS transistor P13 and output bias current Ibias can be represented by Equation (14) given below. This corresponds to Equation (4) of Embodiment 1 described above.

$$Ibias=n\times IP13 \tag{14}$$

Also, the relationship of the electric current at node VS can be represented by Equation (15) given below, where I11 represents the electric current that flows through first current source I11. This corresponds to Equation (5) of Embodiment 1 described above.

$$I11=IP12+IP13 \tag{15}$$

The following Equation (16) is obtained from Equations (13) to (15) given above. This corresponds to Equation (6) of Embodiment 1 described above.

$$I11=m\times Idet+(1/n)\times Ibias \tag{16}$$

In Equation (16) given above, the left-hand side is current I11 of first current source I11, and the right-hand side is a sum of the first current that is proportional to detection current Idet and the second current that is proportional to output bias current Ibias. That is, current bias circuit 15 performs operation such that, current I11 of first current source I11, when it is set to an arbitrary constant value, is equal to a sum of the first current that is proportional to detection current Idet and the second current that is proportional to output bias current Ibias.

Also, capacitor 13 and load circuit 14 are connected to output node VOUT of regulator circuit 200. Capacitor 13 is composed of capacitor C1, and is provided in order to suppress AC variation of output node VOUT. Load circuit 14 is composed of load circuit L11, and load current Iload flows in a direction in which it flows into output node VOUT.

In this example, current I11 of first current source I11 is set to an arbitrary constant value. However, by setting current I11 of first current source I11 to a different arbitrary constant value according to the operation mode (switching of power supply voltage, load current, output voltage, and the like) of regulator circuit 200, it is possible to reduce unnecessary current consumption according to the specifications and application of regulator circuit 200.

In this example, the sources of PMOS transistors P11 to P14 of first current mirror 103 and second current mirror 104 are connected to power supply node VDD. However, power supply node VDD is not necessarily identical to power supply node VDD that is used in error amplifier circuit 11, and the sources of PMOS transistors P11 to P14 of first current mirror 103 and second current mirror 104 may be connected to a power supply node of different voltage. The power consumption of regulator circuit 200 can be reduced by setting the voltage of power supply node VDD that is used in error amplifier circuit 11 to be low according to output voltage VOUT, and using a high voltage in the power supply node that is connected to the sources of PMOS transistors P11 to P14 provided in first current mirror 103 and second current mirror 104, or reversing the voltage relationship of the power supply node.

Power supply node VDD that is connected to load circuit L11 of load circuit 14 shown in FIG. 11 is not necessary identical to power supply node VDD that is connected to the sources of PMOS transistors P11 to P14 of first current mirror 103 and second current mirror 104, and power supply node VDD that is used in error amplifier circuit 11, and may be a different power supply node and voltage.

Because regulator circuit 200 is configured as described above, Equation (17) given below is obtained from the relationship of the electric current at output node VOUT. In a range in which NMOS transistors N11 and N12, and PMOS transistors P11, P12, P13 and P14 operate in a saturation region, Equations (2), and (13) to (17) given above are satisfied. The following Equation (17) corresponds to Equation (1) of Embodiment 1 described above.

$$Iout = Ibias + Iload - Ir\ div \quad (17)$$

Accordingly, from Equations (2), and (13) to (17) given above, output bias current Ibias can be represented by the following Equation (18), and the dependency of output bias current Ibias on load current Iload can be adjusted by the transistor size ratio (k, m, n), current I11 of first current source I11, and current Irdiv that flows through voltage detection circuit 10. This corresponds to Equation (7) of Embodiment 1 described above. As can be seen from the comparison with Equation (7) given above, the sign of current Irdiv is inverted. In Embodiment 1, output bias current Ibias, current Irdiv, and load current Iload function as a sink current to output node VOUT, and output current Iout functions as a source current to output node VOUT, whereas in Embodiment 5, with output current Iout, output current Ibias, and load current Iload, the direction of current is opposite to that of Embodiment 1 (i.e., the functions as a sink current and a source current are interchanged), but current Irdiv functions as a sink current as in Embodiment 1 and thus the sign is inverted. However, the direction in which output bias current Ibias varies with respect to the change in load current Iload does not vary, and operation is performed such that output bias current Ibias decreases when load current Iload increases. It can be seen that regulator circuit 200 essentially performs the same operations as those of Embodiment 1.

$$Ibias = (n \times (I11 - (m/k) \times (Iload - Ir\ div))) / (1 + (m \times n)/k) \quad (18)$$

As described above, the operations of regulator circuit 200 are essentially the same as those of Embodiment 1 except that the direction of current is different. For this reason, the following description will be given focusing on differences in the operations.

When load current Iload increases, current Iout that flows through NMOS transistor N11 of output circuit 12 increases. In response thereto, as indicated by Equation (2) given above, detection current Idet that flows through NMOS transistor N12 of current detection circuit 16 also increases. Detection current Idet is input to current bias circuit 15, and in first current mirror 103, as shown in Equation (13) given above, current IP12 that flows through PMOS transistor P12 is generated in a voltage range of node VS in which PMOS transistor P12 operates in a saturation region. Of current I11 that is allowed to flow out from node VS by first current source I11, current IP12 is allowed to flow into node VS by PMOS transistor P12, and the rest is input to second current mirror 104 so as to satisfy Equation (15) given above, and then flows into node VS as current IP13 that flows through PMOS transistor P13. In second current mirror 103, as shown in Equation (14) given above, output bias current Ibias is generated based on current IP13, and serves as a source current to output node VOUT.

Accordingly, when load current Iload increases, and current IP12 increases via detection current Idet, as shown in Equation (15) given above, the proportion of the amount of current IP12 that flows into node VS to the amount of current I11 of first current source I11 that flows out from node VS increases, and the amount of current IP13 that flows into node VS decreases. Thus, output bias current Ibias also decreases as shown in Equation (14) given above. The voltage of node VS increases with an increase of current IP12, and when a difference between the voltage of node VS and the voltage of power supply node VDD is less than or equal to the threshold voltage of PMOS transistors P13 and P14, PMOS transistors P13 and P14 operate in a sub-threshold region, and current IP13 and output bias current Ibias decrease. When PMOS transistor P12 operates in a linear region due to the increase of the voltage of node VS, the voltage of node VS approaches the voltage of power supply node VDD, and current IP13 and output bias current Ibias reach substantially zero. Accordingly, it is possible to avoid the increase of output voltage VOUT when load current Iload is large.

Here, the increase of output voltage VOUT is described, but in Embodiment 5, as described above, the directions of current of output current Iout and load current Iload are opposite to those of Embodiment 1. For this reason, the direction of variation of output voltage VOUT is also opposite. That is, the direction of variation of output voltage VOUT increases, instead of decreasing. Essentially, the loss at output circuit 12 caused by output bias current Ibias is reduced when load current Iload is large, and it is therefore the same.

When PMOS transistor P12 enters a linear region as a result of the increase of the voltage of node VS due to the increase of current IP12, current IP12 no longer satisfies Equation (13) given above, and is equal to the electric current that flows between node VS and power supply node VDD via the on-resistance of PMOS transistor P12 biased by the gate-to-source voltage that is a difference between the voltage of node VM and the voltage of power supply node VDD, and the drain-to-source voltage of node VS that is a difference between the voltage of node VS and the voltage of power supply node VDD. As described above, with the increase of the voltage of node VS, PMOS transistor P13 operates in a sub-threshold region, and the electric current that flows through PMOS transistor P13 decreases. Accordingly, when PMOS transistor P12 operates in a linear region, current IP12 is substantially equal to current I11 of first current source I11.

With the operations described above, output bias current Ibias decreases when load current Iload shown on the right-hand side of Equation (17) given above increases, and thus the change in output current Iout on the left-hand side of Equation (17) given above is suppressed. Accordingly, the variation of output voltage VOUT can be reduced.

On the other hand, when load current Iload decreases from a state in which it is large, output current Iout that flows through NMOS transistor N11 of output circuit 12 decreases, and detection current Idet that flows through NMOS transistor N12 of current detection circuit 16 decreases according to Equation (2) given above. That is, because the electric current that is input to PMOS transistor P11 of first current mirror 103 of current bias circuit 15 decreases, the voltage of node VM increases, and the on-resistance of PMOS transistor P12 increases accordingly. The increase in the on-resistance of PMOS transistor P12 increases the voltage of node VS. When the voltage of node VS reaches a voltage at which PMOS transistor P12 operates in a saturation region, current IP12 satisfies Equation (13) given above. When the difference between the voltage of node VS and the voltage of power supply node VDD increases to be higher than the threshold voltages of PMOS transistors P13 and P14 of second current mirror 104 of current bias circuit 15, current IP13 that flows through PMOS transistor P13 increases gradually. In response to the decrease of current IP12, current IP13 increases so as to satisfy Equation (15) given above, and output bias current Ibias increases so as to satisfy Equation (14) given above.

As is also clear from Equation (18) given above, by changing the aforementioned design parameters (k, m, n, I11, and Irdiv), it is possible to adjust output bias current Ibias in the unloaded state, the amount of change in output bias current Ibias relative to the change in load current Iload (output bias current–the slope of load current properties), and load current Iload at which output bias current Ibias reaches zero. When adjusting output bias current–load current properties, it is unnecessary to change all of the aforementioned design parameters (k, m, n, I1, and Irdiv) of Equation (18) given above.

As described above, Embodiment 5 is essentially the same as Embodiment 1 although the direction of current, the direction of variation of the voltage, and the like are different. As is also clear from the relationship of output bias current Ibias to load current load, it is possible to suppress the variation of output voltage VOUT due to the change in load current Iload, and avoid the increase of output voltage VOUT even when load current Iload is large.

In Embodiments 2, 3, and 4, by using a circuit configuration in which PMOS transistors and NMOS transistors are replaced in the same manner as the relationship between Embodiment 1 and Embodiment 5 described above, the same advantageous effects can be achieved.

In each of the embodiments described above, current detection circuit 16 can also be implemented by a configuration in which, for example, a resistor is connected in series to output circuit 12, and a potential difference thereacross is received by a transistor so as to convert it to a detection current. However, in the case where a potential difference between the voltage of power supply node VDD and output voltage VOUT is small, when the load current is large, a problem arises in that the operational lower limit voltage increases due to the voltage drop in the voltage output path (specifically, the resistor connected in series to output circuit 12) of regulator circuit 200.

In each of the embodiments described above, current detection circuit 16 has a same configuration as that of output circuit 12 except that the current driving capability is different, and outputs the detection current that is proportional to the magnitude of the output current according to the output voltage of error amplifier circuit 11. Current detection circuit 16 is composed of, for example, PMOS transistor P2 that is connected in parallel to PMOS transistor P1 of output circuit 12 with respect to power supply node VDD. As a result of current bias circuit 15 setting the output bias current to zero when the load current is large, even when the potential difference between the voltage of power supply node VDD and output voltage VOUT is small, it is possible to suppress the variation of the output voltage, and avoid the drop in the output voltage. Also, the increase of the operational lower limit voltage can be avoided without an unnecessary increase of the output transistor size.

As described above, by performing control so as to suppress the variation of the output current by allowing the output bias current to flow when the load current is small, and allowing the output bias current to decrease when the load current is large, it is possible to suppress the output voltage variation relative to the change in the load current. Thus, other than suppressing the variation of the output voltage, the following advantages can be obtained as compared with the conventional technology.

Because the output bias current is caused to decrease when the load current is maximum, it is possible to suppress the drop in the output voltage due to the load current, and suppress the maximum consumption current.

In the case where the amount of decrease of the output voltage when the load current is maximum is set to be the same as that of the conventional technology, the output transistor size can be reduced, and the reduction in the area can be achieved.

By reducing the output transistor size, it is possible to reduce the parasitic capacitor, and control is performed so as to make the variation of the output current to be small with respect to the change in the load current. Accordingly, it is possible to suppress the change in the gate voltage of the output transistor relative to the change in the load current, and improve the response speed.

The setting of the circuit configuration, the signal logic and the predetermined current value in each of the embodiments described above is merely an example, and the present disclosure is not limited thereto.

Although the regulator circuit according to the present disclosure has been described above by way of embodiments, the present disclosure is not limited to the embodiments. The present disclosure also encompasses other embodiments obtained by making various modifications that can be conceived by a person having ordinary skill in the art to the embodiments given here without departing from the scope of the present disclosure, as well as embodiments implemented by any combination of some of the structural elements of the embodiments.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to, in general, a LDO (Low Drop Out) regulator circuit, and other regulator circuits used in semiconductor storage devices such as eDRAM (embedded Random Access Memory), flash memory, and ReRAM (Resistive Random Access Memory), and particularly useful in applications where a high level of accuracy is required for the output voltage.

What is claimed is:

1. A regulator circuit comprising:

a voltage detection circuit that detects a magnitude of an output voltage of an output node, and outputs a feedback voltage that indicates a result of the detection;

an error amplifier circuit that compares the feedback voltage with a reference voltage, and outputs a voltage that indicates a result of the comparison;

an output circuit that supplies an output current to the output node according to the voltage output by the error amplifier circuit;

a current detection circuit that detects a magnitude of the output current; and a current bias circuit that supplies an output bias current to the output node, and increases or decreases the output bias current based on a result of the detection of the current detection circuit, wherein:

the current detection circuit outputs a detection current that is proportional to the output current, the current bias circuit includes a current source that allows a constant current to flow therethrough, the constant current that flows through the current source is a sum of a first current and a second current, and the current bias circuit includes:

a first current mirror that receives an input of the detection current as a reference current, and outputs the first current as a mirror current; and a second current mirror that receives the second current as a reference current, and outputs the output bias current as a mirror current.

2. The regulator circuit according to claim 1, wherein the current detection circuit has a same configuration as a configuration of the output circuit except that a current driving capability is different, and outputs the detection current that is proportional to the magnitude of the output current according to the voltage output by the error amplifier circuit.

3. The regulator circuit according to claim 1, wherein the current detection circuit is provided in parallel to the output circuit.

4. A regulator circuit comprising:

a voltage detection circuit that detects a magnitude of an output voltage of an output node, and outputs a feedback voltage that indicates a result of the detection;

an error amplifier circuit that compares the feedback voltage with a reference voltage, and outputs a voltage that indicates a result of the comparison;

an output circuit that supplies an output current to the output node according to the voltage output by the error amplifier circuit;

a current detection circuit that detects a magnitude of the output current; and a current bias circuit that supplies an output bias current to the output node, and increases or decreases the output bias current based on a result of the detection of the current detection circuit, wherein:

the current detection circuit outputs a detection current that is proportional to the output current, the current bias circuit includes a current source that allows a constant current to flow therethrough, the constant current that flows through the current source is a sum of the detection current and a second current, and the current bias circuit includes a current mirror that receives the second current as a reference current, outputs a mirror current that is proportional to the second current, is connected to the output node, and supplies a sum of the second current and the mirror current to the output node as the output bias current.

5. The regulator circuit according to claim 4, wherein the current bias circuit includes a clamp circuit that is provided in a wire that transmits the detection current from the current detection circuit to the current source, and limits a voltage of a portion of the wire that is on a side of the current source such that the voltage of the portion of the wire does not exceed the output voltage.

6. The regulator circuit according to claim 4, wherein the current detection circuit has a same configuration as a configuration of the output circuit except that a current driving capability is different, and outputs the detection current that is proportional to the magnitude of the output current according to the voltage output by the error amplifier circuit.

7. The regulator circuit according to claim 4, wherein the current detection circuit is provided in parallel to the output circuit.

8. A regulator circuit comprising:

a voltage detection circuit that detects a magnitude of an output voltage of an output node, and outputs a feedback voltage that indicates a result of the detection;

an error amplifier circuit that compares the feedback voltage with a reference voltage, and outputs a voltage that indicates a result of the comparison;

an output circuit that supplies an output current to the output node according to the voltage output by the error amplifier circuit;

a current detection circuit that detects a magnitude of the output current; and a current bias circuit that supplies an output bias current to the output node, and increases or decreases the output bias current based on a result of the detection of the current detection circuit, wherein the current bias circuit includes:

a first current source that includes a first terminal and a second terminal, the first terminal being connected to an arbitrary power supply node or ground node;

a first current mirror that includes an input terminal to receive a reference current, which is connected to an output terminal of the current detection circuit, and an output terminal to output a mirror current, which is connected to the second terminal of the first current source; and a second current mirror that includes an input terminal to receive a reference current, which is connected to the second terminal of the first current source, and an output terminal to output a mirror current, which is connected to the output node.

9. The regulator circuit according to claim 8, wherein the current detection circuit has a same configuration as a configuration of the output circuit except that a current driving capability is different, and outputs the detection current that is proportional to the magnitude of the output current according to the voltage output by the error amplifier circuit.

10. The regulator circuit according to claim 8, wherein the current detection circuit is provided in parallel to the output circuit.

11. A regulator circuit comprising:

a voltage detection circuit that detects a magnitude of an output voltage of an output node, and outputs a feedback voltage that indicates a result of the detection;

an error amplifier circuit that compares the feedback voltage with a reference voltage, and outputs a voltage that indicates a result of the comparison;

an output circuit that supplies an output current to the output node according to the voltage output by the error amplifier circuit;

a current detection circuit that detects a magnitude of the output current; and a current bias circuit that supplies an output bias current to the output node, and increases or decreases the output bias current based on a result of the detection of the current detection circuit, wherein:

the current detection circuit outputs a detection current that is proportional to the output current, and the current bias circuit includes:

a second current source that includes a third terminal that is connected to an arbitrary power supply node or ground node, and a fourth terminal that is connected to an output terminal of the current detection circuit to receive the detection current; and a current mirror that includes an input terminal to receive a reference current, which is connected to the fourth terminal of the second current source, an output terminal to output a mirror current, which is connected to an arbitrary power supply node or ground node, and a source that is connected to the output node.

12. The regulator circuit according to claim 11, wherein the current bias circuit further includes a clamp circuit that includes a first input terminal that is connected to the output terminal of the current detection circuit, a second input terminal that is connected to the output node, and a first output terminal that is connected to the fourth terminal of the second current source and the input terminal of the current mirror, the clamp circuit being configured to limit a potential of the first output terminal.

13. The regulator circuit according to claim 11, wherein the current detection circuit has a same configuration as a configuration of the output circuit except that a current driving capability is different, and outputs the detection current that is proportional to the magnitude of the output current according to the voltage output by the error amplifier circuit.

14. The regulator circuit according to claim 11, wherein the current detection circuit is provided in parallel to the output circuit.

* * * * *